US011145503B2

(12) United States Patent
Dziekonski

(10) Patent No.: US 11,145,503 B2
(45) Date of Patent: Oct. 12, 2021

(54) TWO-DIMENSIONAL FOURIER TRANSFORM MASS ANALYSIS IN AN ELECTROSTATIC LINEAR ION TRAP

(71) Applicant: DH TECHNOLOGIES DEVELOPMENT PTE. LTD., Singapore (SG)

(72) Inventor: Eric Thomas Dziekonski, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 16/981,057

(22) PCT Filed: May 23, 2019

(86) PCT No.: PCT/IB2019/054295
§ 371 (c)(1),
(2) Date: Sep. 15, 2020

(87) PCT Pub. No.: WO2019/229599
PCT Pub. Date: Dec. 5, 2019

(65) Prior Publication Data

US 2021/0074536 A1 Mar. 11, 2021

Related U.S. Application Data

(60) Provisional application No. 62/677,149, filed on May 28, 2018.

(51) Int. Cl.
*H01J 49/00* (2006.01)
*H01J 49/02* (2006.01)
*H01J 49/42* (2006.01)

(52) U.S. Cl.
CPC ..... *H01J 49/4245* (2013.01); *H01J 49/0031* (2013.01); *H01J 49/0036* (2013.01); *H01J 49/0054* (2013.01); *H01J 49/027* (2013.01)

(58) Field of Classification Search
CPC ..... H01J 49/4245; H01J 49/0031; H01J 49/0036; H01J 49/0054; H01J 49/027
(Continued)

(56) References Cited

U.S. PATENT DOCUMENTS 6,888,130 B1 5/2005 Gonin
2011/0240841 A1* 10/2011 Lange ..... H01J 49/425 250/282
(Continued)

OTHER PUBLICATIONS

International Search Report and Written Opinion for PCT/IB2019/054295, dated Oct. 10, 2019.
(Continued)

*Primary Examiner* — Nicole M Ippolito
(74) *Attorney, Agent, or Firm* — John R. Kasha; Kelly L. Kasha; Kasha Law LLC

(57) ABSTRACT

A mass spectrometer is operated to simultaneously measure precursor and production data over a number of acquisitions. For each acquisition, the following steps are performed. Ion transfer optics inject ions from an ion beam into an ELIT causing the ions to oscillate axially between two electric fields produced by two the sets of reflectrons. The ELIT measures a time domain image current of the oscillating ions from ion injection to a total acquisition time, Tacq1, and fragments the oscillating ions at one or both turning points of the oscillating ions adding product ions to the oscillating ions. The fragmentation is performed at a delay time relative to the ion injection that is increased by a time increment in each subsequent acquisition making the fragmentation dependent on ion position. The measured time domain image current is stored as a row or column of a two-dimensional matrix.

15 Claims, 16 Drawing Sheets

(58) Field of Classification Search
USPC ..... 250/281, 282, 283
See application file for complete search history.

(56) References Cited

U.S. PATENT DOCUMENTS

2012/0112056 A1* 5/2012 Brucker ..... H01J 49/4245
250/282
2015/0028197 A1* 1/2015 Grinfeld ..... H01J 49/406
250/282
2015/0380233 A1* 12/2015 Verenchikov ..... H01J 49/406
250/282

OTHER PUBLICATIONS

Floris et al. "2D FT-ICR MS of Calmodulin: A Top-Down and Bottom-Up Approach," Journal of the American Society for Mass Spectrometry, Elsevier Science Inc., US, vol. 27, No. 9, Jul. 18, 2016, pp. 1531-1538, XP036278815, ISSN: 1044=0305, DOI: 10/1007/S13361-016-1431-Z.
Van Agthoven et al. "Two-Dimensional Mass Spectrometry in a Linear Ion Trap, an in silico Model: 2D MS in a Linear Ion Trap," Rapid Communications in Mass Spectrometry, vol. 31, No. 8, Mar. 14, 2017, pp. 674-684, XP055624546, GB, SSN: 0951-4198, DOI: 10.1002/rcm.7836.

* cited by examiner

100

300

400

900

1100

TWO-DIMENSIONAL FOURIER TRANSFORM MASS ANALYSIS IN AN ELECTROSTATIC LINEAR ION TRAP

RELATED APPLICATIONS

This application claims the benefit of U.S. Provisional Patent Application Ser. No. 62/677,149, filed on May 28, 2018, the content of which is incorporated by reference herein in its entirety.

INTRODUCTION

The teachings herein relate to operating or controlling a mass spectrometer to perform two-dimensional Fourier transform mass analysis or mass spectrometry (2D FT MS) in an electrostatic linear ion trap (ELIT). In 2D FT MS, precursor ion and product ion data are recorded simultaneously, and product ions are matched to their corresponding precursor ions without performing precursor ion isolation.

More particularly, the teachings herein relate to systems and methods that perform 2D FT MS with an ELIT using only excitation and fragmentation pulses. This is a significant improvement over conventional systems that additionally require complex encoding pulses to perform 2D MS. The systems and methods disclosed herein are performed in conjunction with one or more processors, controllers, microcontrollers, or computer systems, such as the computer system of FIG. 1.

Background on Mass Spectrometry Techniques

In general, tandem mass spectrometry, or mass spectrometry/mass spectrometry (MS/MS), is a well-known technique for analyzing compounds. Tandem mass spectrometry involves ionization of one or more compounds from a sample, selection of one or more precursor ions of the one or more compounds, fragmentation of the one or more precursor ions into fragment or product ions, and mass analysis of the product ions.

Tandem mass spectrometry can provide both qualitative and quantitative information. The product ion spectrum can be used to identify a molecule of interest. The intensity of one or more product ions can be used to quantitate the amount of the compound present in a sample.

Conventional tandem mass spectrometry relies upon precursor ion isolation before activation and dissociation. Activation and dissociation are also collectively referred to hereinafter as fragmentation. For highly complex mixtures, e.g., crude oil or blood, many compounds may share the same nominal mas-to-charge ration (m/z), and it may not be possible to mass isolate an ion of interest to perform tandem mass spectrometry, especially in a quadrupole. Additionally, to obtain the MS/MS mass spectrum of every ion present in the sample, the number of injection, isolation, fragmentation, and analysis steps scales linearly with the number of different ions.

2D FT-ICR MS

It is well known that 2D FT MS can be performed using Fourier transform ion cyclotron resonance mass spectrometry (FT-ICR MS). FT-ICR MS is performed using an FT-ICR mass spectrometer.

FIG. 2 is a schematic diagram 200 of an FT-ICR mass spectrometer. The FT-ICR mass spectrometer of FIG. 2 includes ion source 210, ion transfer optics 220, ICR cell or trap 230, and super-conducting magnet 240. The large size of super-conducting magnet 240 makes an FT-ICR mass spectrometer expensive to purchase and operate.

A paper entitled "2D FT-ICR MS of Calmodulin: A Top-Down and Bottom-Up Approach" by Floris et al., J. Am. Soc. Mass Spectrom. (2016), 27: 1531-1538, (hereinafter the "Floris Paper") illustrates how 2D FT MS is performed using FT-ICR MS. The Floris Paper describes that 2D FT MS "allows data independent fragmentation of all ions in the sample and correlation of precursor and fragment ions without prior isolation" and that this "correlation is obtained through the modulation of precursor ions' cyclotron radii prior to fragmentation using a series of" radio frequency (RF) pulses. In other words, the correlation of precursor ions with fragment ions is made possible through the use of a series of RF pulses. The Floris Paper refers to these RF pulses as an encoding pulse. In order to perform a 2D FT MS experiment using an FT-ICR mass spectrometer (2D FT-ICR MS), the Floris Paper describes applying three other types of pulses in addition to the encoding pulse.

FIG. 3 is a timing diagram 300 from the Floris Paper showing the four pulses necessary for performing 2D FT-ICR MS in the ICR cell of an FT-ICR mass spectrometer. Ions enter the ICR cell axially and are excited by an excitation pulse 310. According to the Floris Paper, "ions rotate inside the cell according to their cyclotron frequency for an encoding time to accumulate a phase." An encoding pulse 320, equal to excitation pulse 310, "is then applied, and the ions are either excited further or de-excited, depending on their instantaneous phase relative to" encoding pulse 320. At the end of encoding pulse 320, "the ions' cyclotron radii are modulated according to" the encoding time and their cyclotron frequency.

Encoding pulse 320 is followed by a fragmentation period, "in which the ions are subjected to radius-dependent fragmentation, and produce fragment ions whose abundances dependent on" the encoding time and the cyclotron frequency of the precursor ions. The radius dependent fragmentation is depicted by fragmentation pulse 330. Note that fragmentation pulse 330 is not an RF pulse like the other pulses. The Floris Paper provides that fragmentation pulse 330 can include in-cell collisional dissociation with neutral gas pulses, infrared multiphoton dissociation (IRMPD), or electron capture dissociation (ECD), for example.

After fragmentation pulse 330, observation pulse 340 is applied. Observation pulse 340 excites both precursor ions and fragment ions so that they can be detected by the ICR cell of the FT-ICR mass spectrometer. 2D MS in a LIT As described above, FT-ICR mass spectrometers are expensive to purchase and operate. As a result, lower cost alternatives for performing 2D FT MS are continually being sought. In a paper entitled "Two-dimensional mass spectrometry in a linear ion trap, an in silico model" by van Agthoven et al., Rapid Commun. Mass Spectrom. (2017), 31: 674-684, (hereinafter the "van Agthoven Paper") a simulation of 2D MS (non-FT) in a quadrupole linear ion trap (LIT) was performed.

FIG. 4 is a schematic diagram 400 of the quadrupole LIT used in the simulation in the van Agthoven Paper. In the simulation of the van Agthoven Paper, ion source 410 supplies precursor ions to quadrupole LIT 420. Ions are stored in quadrupole LIT 420 by applying a direct current (DC) voltage on the end-cap electrodes of quadrupole LIT 420 using a voltage generator (not shown) and a radio frequency (RF) voltage on the quadrupole rods of quadrupole LIT 420 using RF voltage generator 421. The DC voltage and the RF voltage collectively are, for example, an excitation pulse. An encoding pulse is added to the RF voltage on the quadrupole rods of quadrupole LIT 420 using encoding modulator 422. The encoding pulse is added only to one pair of rods (opposite phase on each rod), just like dipolar excitation is performed. The encoding pulse includes stored waveform ion radius modulation (SWIM) pulse, for example. After the encoding pulse is applied, a fragmentation pulse is applied axially. For example, laser 430 can provide the fragmentation pulse to perform photo dissociation.

In the van Agthoven Paper, the experiment is repeated 128 times, using a different SWIM encoding pulse each time. Each SWIM pulse excites the ions (amplitude is frequency dependent) and causes the radius of the ion cloud to increase. As the radius of the ion cloud is increased, the fragmentation efficiency is decreased (less ions within the fragmentation zone). The fragmentation efficiency is therefore directly related to the amplitude/duration of the excitation waveform at the ions secular frequency. Each different SWIM waveform has a different amplitude vs. frequency profile.

This, in turn, causes the count of different precursor ions to vary differently with respect to the 128 SWIM pulse indices. The count of the different precursor ions decreases at different 128 SWIM pulse indices, for example. The van Agthoven Paper shows that the frequency at which product ions, produced from the fragmentation pulses, vary with respect to the 128 SWIM pulse indices is the same as their precursor ions. In other words, the van Agthoven Paper shows that the encoding pulse made up of 128 SWIM pulse indices could be used to correlate precursor ions to their product ions and allow 2D MS.

FIG. 5 is a timing diagram 500 from the van Agthoven Paper showing the pulses applied in the quadrupole LIT simulation to allow 2D MS. As described above, the simulation is repeated 128 times. Each of the pulses is shown on a timeline that is the total timeline for a single simulation. For example, the simulation begins at time 501 and ends at time 509. At the beginning of the simulation, an ionization pulse 510 or amount of time is provided for ionizing the sample and filling the quadrupole LIT with ions. For the entire simulation, an RF signal 520 is applied to the quadrupole rods and a DC signal 530 is applied to the end-caps of the quadrupole LIT. RF signal 520 is the RF trapping field applied to the quadrupole and is constant throughout the experiment. Similarly, DC signal 530 confines the ions in the axial dimension and is constant throughout the experiment.

After ionization, but before fragmentation, the excitation and encoding pulse 540 is applied. Excitation and encoding pulse 540 pulse consists of a single SWIM waveform. Finally, after the encoding pulse is applied, the fragmentation pulse 550 is applied to fragment precursor ions. The experiment is repeated 128 times with a different Excitation and encoding pulse 540.

Encoding Problem

Although the quadrupole LIT proposed in the van Agthoven Paper has significant cost advantages over an FT-ICR mass spectrometer for performing 2D MS, it still involves a similar level of complexity. In particular, like 2D FT-ICR MS, a complex encoding pulse is required to correlate precursor ions to product ions. More importantly, the resolution of the 2D mass spectrum produced by a quadrupole LIT is ultimately limited by the mass analyzer. Using a quadrupole, it is only possible to achieve a resolution of several thousand. As a result, additional systems and methods are needed to reduce the complexity required to perform 2D MS.

SUMMARY

A system, method, and computer program product are disclosed for controlling a mass spectrometer to simultaneously measure precursor and product ion data. All three embodiments include the following steps.

Ion transfer optics and an ELIT of a mass spectrometer are controlled to perform a total number of acquisitions, N, using a processor. A number of steps are performed for each acquisition, n, of the N acquisitions using a processor. The ion transfer optics are controlled to inject ions from the ion beam into the ELIT causing the ions to oscillate axially between two electric fields produced by two the sets of reflectrons. The ion beam is produced by an ion source configured to ionize a sample. The ELIT includes the two sets of reflectrons, one or more pickup electrodes, and a fragmentation device.

The ELIT is controlled to measure a time domain image current of the oscillating ions from ion injection to a total acquisition time, $T_{acq1}$, using the one or more pickup electrodes. The ELIT is controlled to perform position-dependent fragmentation of the oscillating ions within $T_{acq1}$ at one or both turning points of the oscillating ions adding product ions to the oscillating ions using the fragmentation device. The fragmentation is performed at a delay time, $t_{act}$, relative to the ion injection that is increased by a time increment, $\Delta t$, in each subsequent acquisition, n+1, making the fragmentation of the oscillating ions dependent on their position.

The delay time, $t_{act}$, can be increased using uniform sampling or nonuniform sampling. In uniform sampling, the delay time, $t_{act}$, is increased by a constant time increment, $\Delta t$. In nonuniform sampling, the delay time, $t_{act}$, is increased by a varying time increment, $\Delta t$, that allows data points to be skipped and the total number of acquisitions to be reduced.

The measured time domain image current is stored as a row or column n of a two-dimensional matrix in a memory device. One of ordinary skill in the art will understand that this data can alternatively be stored in a row of the matrix since the same matrix operations can be performed on a column or a row.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
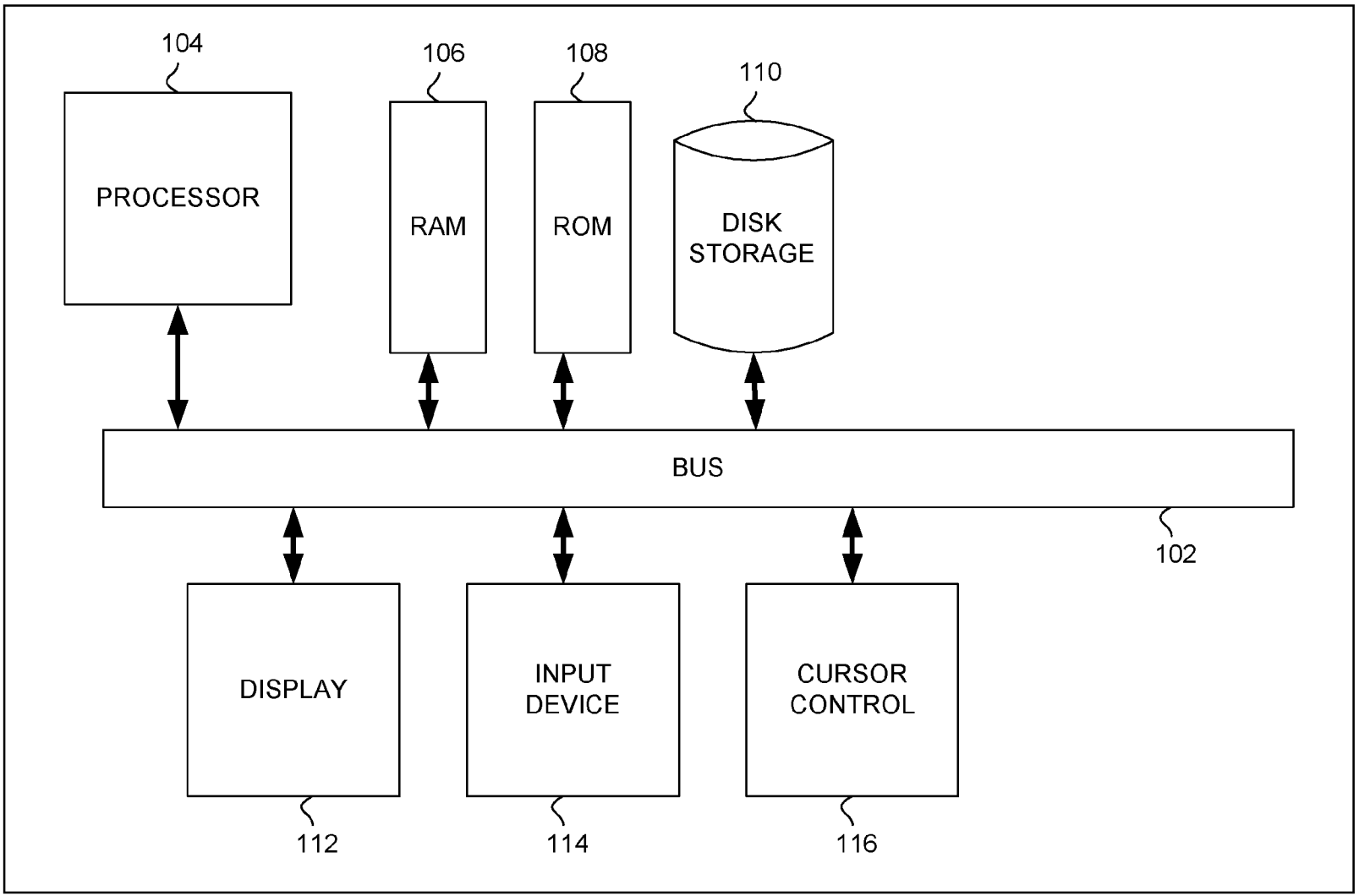
FIG. 1 is a block diagram that illustrates a computer system, upon which embodiments of the present teachings may be implemented.
Figure 2:
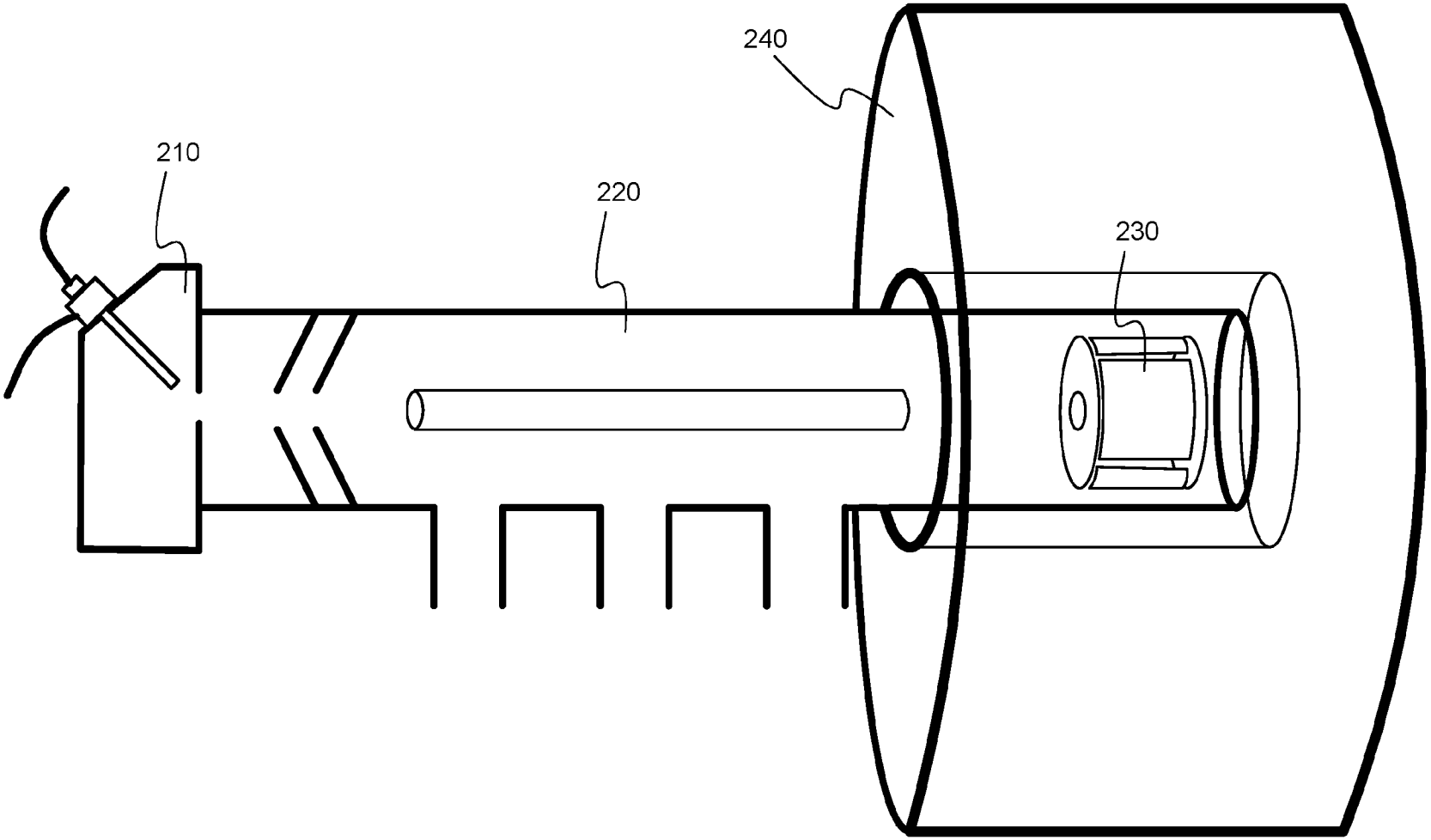
(PRIOR ART) FIG. 2
FIG. 2 is a schematic diagram of a Fourier transform ion cyclotron resonance (FT-ICR) mass spectrometer.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively, hard-wired circuitry may be used in place of or in combination with software instructions to implement the present teachings. Thus, implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

2D FT MS IN AN ELIT

As described above, conventional tandem mass spectrometry generally relies upon precursor ion isolation before fragmentation. Precursor ion isolation, however, is often difficult to perform in complex samples and causes product ion mass analysis to scale linearly with the number of different precursor ions.

Two-dimensional Fourier transform mass spectrometry (2D FT MS) provides a significant improvement over conventional tandem mass spectrometry. In 2D FT MS, precursor ion and product ion data are recorded simultaneously, and product ions are matched to their corresponding precursor ions without performing precursor ion isolation.

It is well known that 2D FT MS can be performed using a Fourier transform ion cyclotron resonance (FT-ICR) mass spectrometer. However, performing 2D FT MS on an FT-ICR mass spectrometer is complex. It requires an excitation pulse, an encoding pulse, a fragmentation pulse, and an observation pulse to perform the analysis. In addition, the large size of the super-conducting magnet makes an FT-ICR mass spectrometer expensive to purchase and operate.

As a result, lower cost alternatives for performing 2D FT MS are continually being sought. One alternative is to perform 2D MS using a quadrupole linear ion trap (LIT). A quadrupole LIT mass spectrometer is certainly less expensive to purchase and operate than an FT-ICR mass spectrometer. However, a major drawback to performing 2D-MS in a LIT is the very limited resolution. The 2D-MS resolution can only be as good as the mass analyzers resolution, which in a LIT is quite poor.

In various embodiments, 2D FT MS is performed using an electrostatic linear ion trap (ELIT). An ELIT is less expensive that an FT-ICR mass spectrometer and can provide greater resolution than a quadrupole LIT mass spectrometer. Also, complexity is reduced because an ELIT allows 2D FT MS to be performed simply using fragmentation pulse. In other words, the encoding pulse needed when using an FT-ICR mass spectrometer or a quadrupole LIT mass spectrometer is eliminated. Instead, simply varying the timing of the fragmentation pulse with each subsequent excitation pulse allows precursor ions to be correlated to product ions.

As a result, in various embodiments, an ELIT mass spectrometer simultaneously records all MS/MS data, without precursor ion isolation. Also, the number of scans or acquisitions does not depend on the number of precursor ions present in the mixture, but rather the frequency of the lightest precursor ion of interest.

Figure 6:
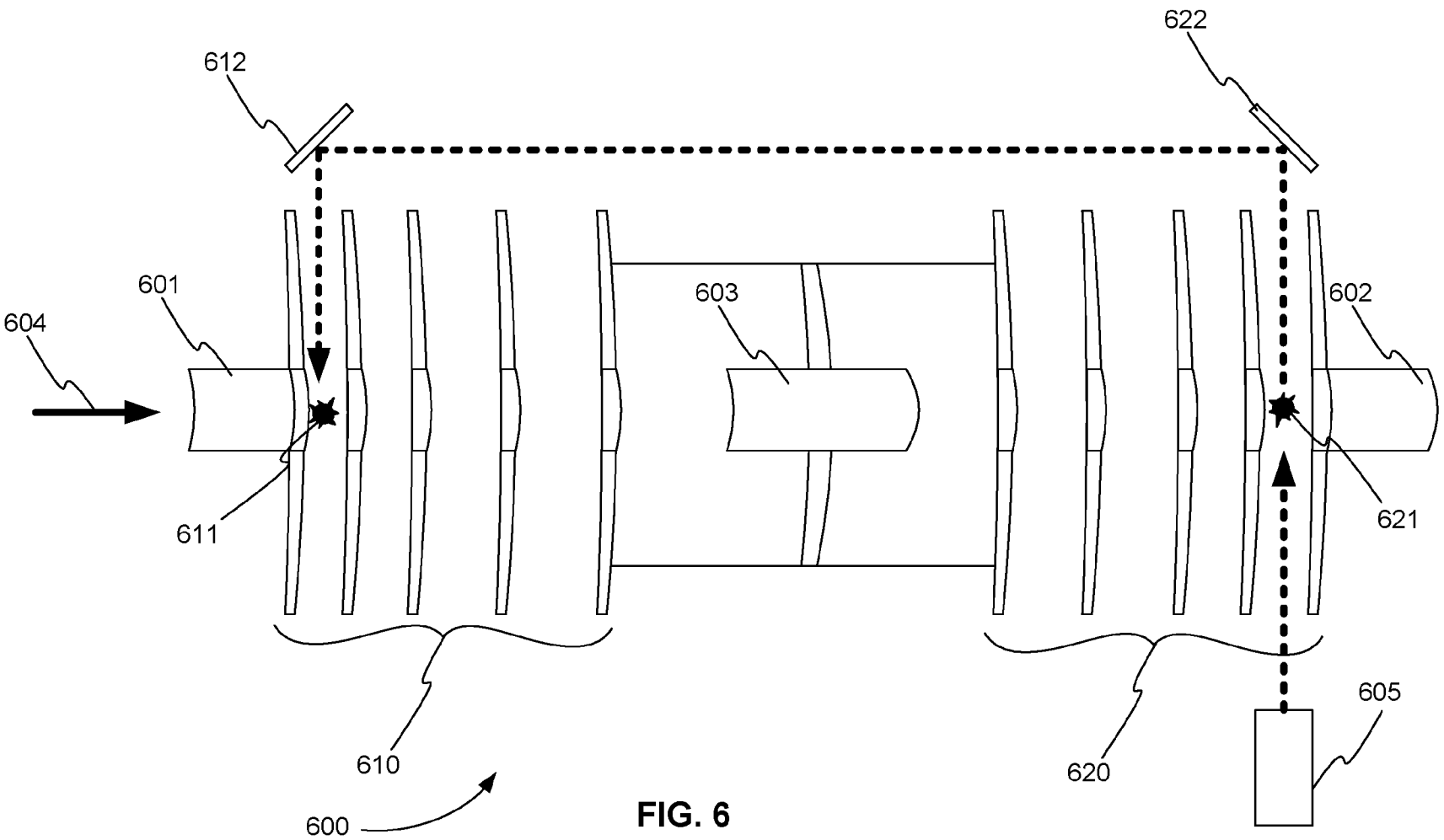
FIG. 6 is a cross-sectional side view of an electrostatic linear ion trap (ELIT) for performing 2D FT MS, in accordance with various embodiments.

FIG. 6 is a cross-sectional side view 600 of an ELIT for performing 2D FT MS, in accordance with various embodiments. The ELIT of FIG. 6 is cylindrical in shape. It includes ion inlet 601, first set of reflectrons 610, pickup electrode 603, second set of reflectrons 620, and ion outlet 602.

First set of reflectrons 610 and second set of reflectrons 620 each include a number of parallel coaxial electrodes with holes in the middle. The coaxial electrodes shown in FIG. 6 are circular plates. In various embodiments, the coaxial electrodes of can be conical electrodes.

In the ELIT of FIG. 6, precursor ions 604 are injected axially through ion inlet 601 and oscillate axially between first set of reflectrons 610 and second set of reflectrons 620. Precursor ions 604 oscillate axially between first set of reflectrons 610 and second set of reflectrons 620 due to the voltages applied to the reflectrons and the electric field they produce. In various embodiments, precursor ions 604 can be injected into the ELIT by mirror-switching (axial injection), in-trap potential lift (axial injection), or pulsed deflectors (radial injection), for example.

In order to perform 2D FT MS and analyze product ions as well as precursor ions, the ELIT of FIG. 6 further includes fragmentation device 605. In FIG. 6, fragmentation device 605 is a light source that produces ultraviolet light for ultraviolet photo dissociation (UVPD). Fragmentation device 605 directs ultraviolet light to turning point 621 and through mirrors 622 and 612 to turning point 611. Turning points 611 and 621 are the axial locations where ions stop and change direction in their oscillations. Precursor ions at turning points 611 and 621 are simultaneously activated and dissociated (fragmented) producing product ions. These product ions then oscillate along with the precursor ions between first set of reflectrons 610 and second set of reflectrons 620.

In various embodiments, precursor ions at turning points 611 and 621 can be fragmented using a dissociation method other than UVPD. For example, precursor ions at turning points 611 and 621 can be fragmented using surface-induced dissociation (SID), beam of light (e.g., infrared multiphoton), electrons (e.g., electron activated dissociation), or neutrals. The dissociation method may be applied radially via a beam of light, atoms, or electrons as shown in FIG. 6. In various embodiments, the dissociation may be surface induced or via a flood of low-energy electrons.

No matter which dissociation technique is chosen, the activation process must lead to rapid dissociation. Any delay in fragmentation (metastable ions) allows for phase randomization of the product ions, loss of packet coherence (lower signal), loss of ions from the trap due to unstable trajectories, or kinetic energy partitioning upon dissociation. This type of experiment works for any ELIT geometry so long as radial activation can be performed at the turning points (minimizes kinetic energy partitioning). This requires holes in cylindrical/conical reflectrons or a gap between parallel plate electrodes.

Pickup electrode 603 is used to measure an induced image charge or current produced by the oscillating precursor or product ions. The measured imaged current is digitized and recorded, for example.

In FIG. 6, a single central pickup electrode 603 is used. However, any detection electrode configuration will work. Because this method of performing 2D FT MS is most useful for the analysis of complex mixtures, it is best to adopt a detection scheme that minimizes harmonic content, thereby simplifying the mass spectrum. U.S. Provisional Application No. 62/562,597 describes an ELIT detection scheme that minimizes harmonic content, for example, and is incorporated herein by reference.

A Fourier transform is applied to the induced current signal measured from pickup electrode 603 to obtain the oscillation frequency or frequencies of the ions. From the oscillation frequency or frequencies, the m/z of one or more ions can be calculated. After a measurement, the remaining ions can be ejected from the ELIT using ion outlet 602. Ions can be ejected through inlet 601 as well.

The rate at which the image current is sampled needs to fulfill the Nyquist criterion, i.e., the sampling rate ($f_{s1}$) needs to be greater than twice the highest detected ion frequency (precursor ion and product ion). The transient or time domain measurement of the image current is processed using a Fast Fourier transform (FFT) algorithm, for example, after which the frequency domain can be displayed in magnitude mode, absorption mode, or an enhanced Fourier transform (eFT™) mode. The time domain can also be processed via super-resolution methods such as filter diagonalization method (FDM), least-squares analysis, or or phased spectrum deconvolution method (ϕDSDM). The fundamental detected frequency of an ion in an ELIT is inversely proportional to the square root of the ion's mass-to-charge ratio (m/z) as shown in the following equation (1).

$$f = \frac{k}{\sqrt{\frac{m}{z}}} + b \tag{1}$$

In equation (1), k and b are constants related to the ELIT geometry, the kinetic energy of the ions, the electrode potentials, the detection electrode configuration, and the number of detection electrodes. By using a set of known compounds, the frequency spectrum can be calibrated and converted to a mass spectrum via equation 1.

A single analysis of a packet of precursor ions from a sample using the ELIT of FIG. 6 can be referred to as a single scan, injection, or acquisition. In a single acquisition of precursor ions from a sample, the precursor ions are injected into the ELIT of FIG. 6 causing them to oscillate between the sets of reflectrons 610 and 620, and the precursor ions are fragmented using fragmentation device 605 producing product ions that are also caused to oscillate between reflectrons. The injection of the precursor ions 604 into the ELIT is, therefore, the excitation pulse of the acquisition. The fragmentation of the precursor ions by the fragmentation device 605 is the fragmentation pulse of the acquisition.

As a result, the ELIT of FIG. 6 is able to analyze a precursor ion packet using only an excitation pulse and a fragmentation pulse. An encoding pulse is not necessary. Instead of using an encoding pulse, the ELIT shifts the timing of the fragmentation pulse with respect to the excitation pulse in consecutive acquisitions in order to correlate precursor ions to product ions.

The time at which fragmentation (also referred to as activation and dissociation) is performed is referred to as the activation time ($t_{act}$). The activation time is altered for each subsequent injection by increasing the delay time relative to ion injection. For each activation time, a transient is recorded that spans from t=0 to the total acquisition time, $T_{acq1}$. The total acquisition time is determined from the sampling rate, $f_{s1}$, and the number of samples in the transient, $N_s$, according to the following equation, $T_{acq1}=(N_s-1)/f_{s1}$. The time difference, $\Delta t_{act}$, between activation times in different acquisitions is chosen such that the effective sampling frequency, $f_{s2}$, of the delay times is greater than twice the detected frequency of the lightest precursor ion of interest. In practice, $f_{s2}$ is less than, or equal to, $f_{s1}$.

Over time, a precursor ion enters the activation or fragmentation region of the ELIT via normal axial oscillations, resulting in dissociation, and an increase in the abundance of its product ions. As the precursor ion leaves the activation region, fewer ions are dissociated, and the abundance of the product ions is decreased. Therefore, the intensities of the precursor and products ions both are modulated at the detected frequency of the precursor ion, although the product ion intensities are 180 degrees out of phase with that of their precursor ions.

Figure 7:
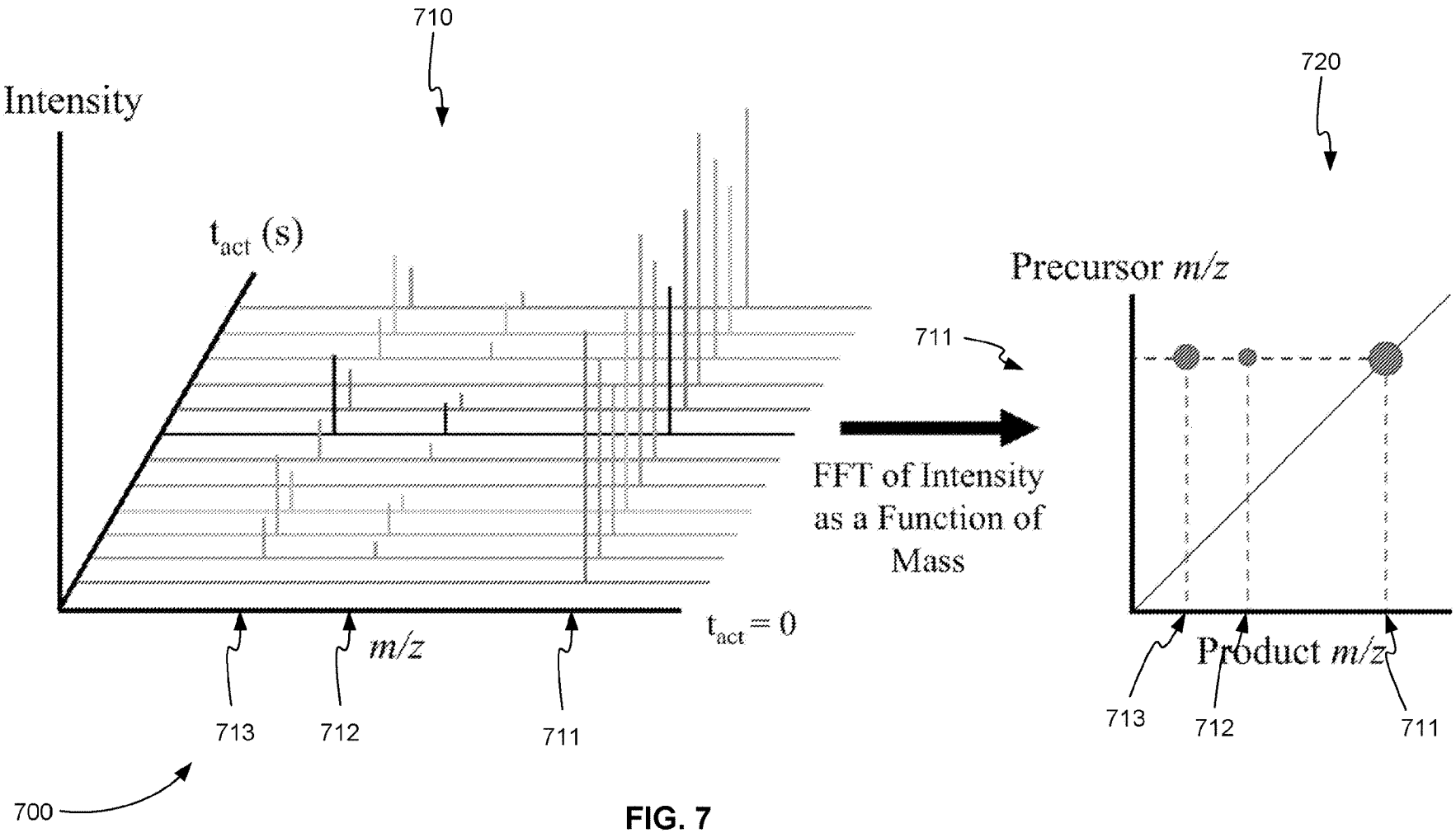
FIG. 7 is a diagram that shows a three-dimensional (3D) plot of hypothetical data from multiple consecutive acquisitions in which an ELIT shifts the timing of the fragmentation pulse and shows a corresponding two-dimensional (2D) mass spectrum of precursor ion m/z versus product ion m/z, in accordance with various embodiments.

FIG. 7 is a diagram 700 that shows a three-dimensional (3D) plot of hypotheitcal data from multiple consecutive acquisitions in which an ELIT shifts the timing of the fragmentation pulse and shows a corresponding two-dimensional (2D) mass spectrum of precursor ion m/z versus product ion m/z, in accordance with various embodiments. 3D plot 710 shows 12 product ion spectra found for 12 different acquisitions of precursor ions from a sample. For each acquisition, the time of fragmentation or activation, $t_{act}$, is incremented. The 12 product ion spectra provide intensity as a function of mass and are, therefore, the depiction of the data after a Fourier transform has been applied.

The 12 product ion spectra show peaks for one precursor ion m/z 711 and two product ion m/z values 712 and 713. It is apparent from 3D plot 710 that the intensities of precursor ion m/z 711 and product ion m/z values 712 and 713 vary periodically with the increasing activation time, $t_{act}$. In fact, the intensities of precursor ion m/z 711 and product ion m/z values 712 and 713 are modulated at the same frequency. However, the frequency of modulation the intensities of product ion m/z values 712 and 713 is 180° out of phase with the frequency of modulation of the intensities of precursor ion m/z 711. As described above, this shows that product ion m/z values 712 and 713 are product ions of the precursor ion of precursor ion m/z 711. It also graphically depicts how product ions with m/z values 712 and 713 are correlated to the precursor ion with m/z 711.

From 3D plot 710, it is apparent how 2D mass spectrum 720 of precursor ion m/z versus product ion m/z is obtained. The x-axis of 2D mass spectrum 720 corresponds to the modulation of product ions with m/z. The y-axis of 2D mass spectrum 720 corresponds to the modulation of precursor ions with an m/z or more directly activation time, $t_{act}$. The three different peaks of 3D plot 710 all have different m/z values 711, 712, and 713 with respect to the x-axis of 2D mass spectrum 720. However, they all correspond to the same m/z value 711 along the y-axis of 2D mass spectrum 720. This is because they have the same modulation frequency with respect to $t_{act}$ and this modulation frequency corresponds to the m/z of the precursor ion m/z 711.

The product ion mass resolution (horizontal x-axis of 2D mass spectrum 720) is improved by increasing the number of samples (transient length) at each delay time. The precursor ion mass resolution (vertical y-axis of 2D mass spectrum 720) is improved by increasing the total number of scans or activation times ($N_a$) such that the maximum delay time, $T_{acq2}=(N_a-1)/f_{s2}$, is increased.

In FIG. 6, ion fragmentation is performed at two turning points. If, however, ion fragmentation can only be performed at one turning point, then the frequency at which the amplitudes are modulated (dissociation frequency) is half the detected frequency via image current/charge detection (2·lap_frequency). As the maximum mass resolution ($R_{max}$) in a Fourier transform instrument can be calculated as $R_{max}=m/\Delta m_{50\%}=f/(2\times(1/T_{acq}))=(f-T_{acq})/2$. It follows, therefore, that the precursor mass resolution is half that of the product ion mass resolution when $T_{acq1}=T_{acq2}$. Therefore, to obtain the same mass resolution in both dimensions requires that twice as many scans ($2N_a$) be recorded.

Figure 8:
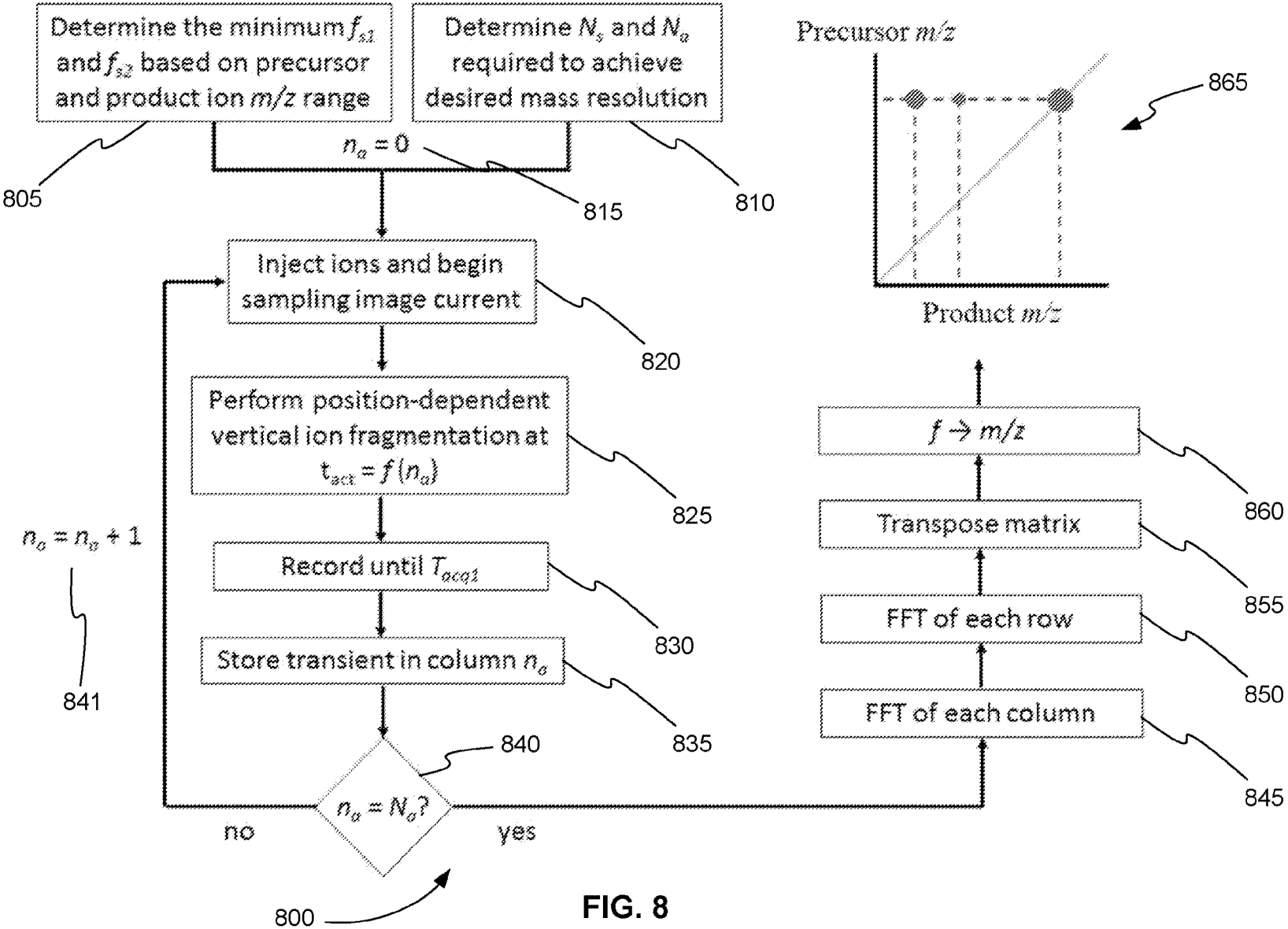
FIG. 8 is an exemplary flowchart showing a workflow for performing 2D FT MS with an ELIT, in accordance with various embodiments.

FIG. 8 is an exemplary flowchart 800 showing a workflow for performing 2D FT MS with an ELIT, in accordance with various embodiments. In step 805, the sampling frequency of image current, $f_{s1}$, and the effective sampling frequency, $f_{s2}$, of delay times are selected. Recall that based on the Nyquist criterion, the sampling rate $f_{s1}$ needs to be greater than twice the highest detected ion frequency (precursor ion and product ion). The effective sampling frequency, $f_{s2}$, of the delay times must be greater than twice the detected frequency of the lightest precursor ion of interest.

In step 810, the number of samples in a transient, $N_s$, and the total number of acquisitions or activation times, $N_a$, are selected. Recall, the product ion mass resolution is improved by increasing $N_s$. So, $N_s$ is selected based on the desired product ion mass resolution. The precursor ion mass resolution is improved by increasing $N_a$. So, $N_a$ is selected based on the desired precursor ion mass resolution.

In step 815, the count of acquisitions, $n_a$, is initialized to zero.

In step 820, an acquisition is begun by injecting precursor ions into ELIT, causing them to oscillate between sets of reflectron on plates. In addition, the measurement of the image current at the pickup electrode of the ELIT is begun using the selected sampling frequency of image current, $f_{s1}$, and the selected number of samples in a transient, $N_s$.

In step 825, a position-dependent fragmentation is performed at an activation time, $t_{act}$, that is a function of the count of acquisitions, $n_a$. As described above, position-dependent fragmentation means that fragmentation is performed at one or both of the turning points of the ions in the ELIT.

In step 830, the acquisition time is checked. The transient image current data is measured at the pickup electrode of the ELIT until the total acquisition time, $T_{acq1}$, is reached. Recall that the total acquisition time is determined from the sampling rate, $f_{s1}$, and the number of samples in the transient, $N_s$, according to the following equation, $T_{acq1}=(N_s-1)/f_{s1}$.

In step 835, if the total acquisition time, $T_{acq1}$, is reached, the acquisition is ended, and the measured transient image current data is stored in a matrix. The measured transient image current data for the acquisition is stored in a column of the matrix representing the count of acquisitions, $n_a$, for example. One of ordinary skill in the art will understand that this data can alternatively be stored in a row of the matrix since the same matrix operations can be performed on a column or a row.

In step 840, the count of acquisitions, $n_a$, is compared to the selected total number of acquisitions, $N_a$. If the count of acquisitions, $n_a$, is less than the selected total number of acquisitions, $N_a$, the count of acquisitions, $n_a$, is incremented at step 841 and a new acquisition is begun by returning to step 820. $n_a$, is incremented by 1 in step 841, but can be incremented by more if using non-uniform sampling. If the count of acquisitions, $n_a$, is equal to the selected total number of acquisitions, $N_a$, the experiment is ended and the stored data is analyzed by moving to step 845.

In step 845, a Fourier transform is performed on each column of the stored matrix.

In step 850, a Fourier transform is performed on each row of the stored matrix.

In step 855, the transformed stored matrix is transposed.

In step 860, the data in the transformed stored matrix is converted from frequency data to m/z data. This data is converted using for example equation (1) described above. The converted stored matrix data can be plotted as 2D spectrum 865. 2D spectrum 865 is a 2D map with the vertical axis corresponding to the precursor ion m/z and the horizontal axis corresponding to the product ion m/z.

ELIT vs. FT-ICR

An ELIT is purely electrostatic device (low power), requiring no external superconducting magnet or RF supplies. This quality makes the mass analyzer compact, field portable, and amenable to benchtop instrumentation. One can be made from commercial, off-the-shelf, stainless steel plates and is very inexpensive to construct and operate.

In an ELIT, all ions, regardless of m/z, undergo excitation by injection and are brought into the activation region by their natural axial oscillations of the trap (frequency is m/z dependent). The fragmentation efficiency can simply be tuned by adjusting the activating beam power and/or the width of the injected ion packet. Therefore, only the time delay between ion injection and ion activation plays a critical role in the generation of a 2D mass spectrum (single TTL trigger). Considering the time base accuracy of modern delay generators, waveform generators, lasers, etc., this is not an issue. While one mass spectrum is being recorded, the next ion population can be trapped in the injection device, cooled, and bunched, such that once the previous transient is completed, the following can be initiated (10-20 μs delay). Depending on the m/z range and the mass resolution required, the duty cycle of 2D FT-ELIT MS can easily approach 100%.

The frequency (mass resolution) of an ion is inversely related to the square root of its m/z in an ELIT, whereas in an FT-ICR the frequency is inversely related to the ions m/z. This gives an ELIT a mass resolution advantage in the measurement of high m/z ions which hold biological relevance.

Figure 3:
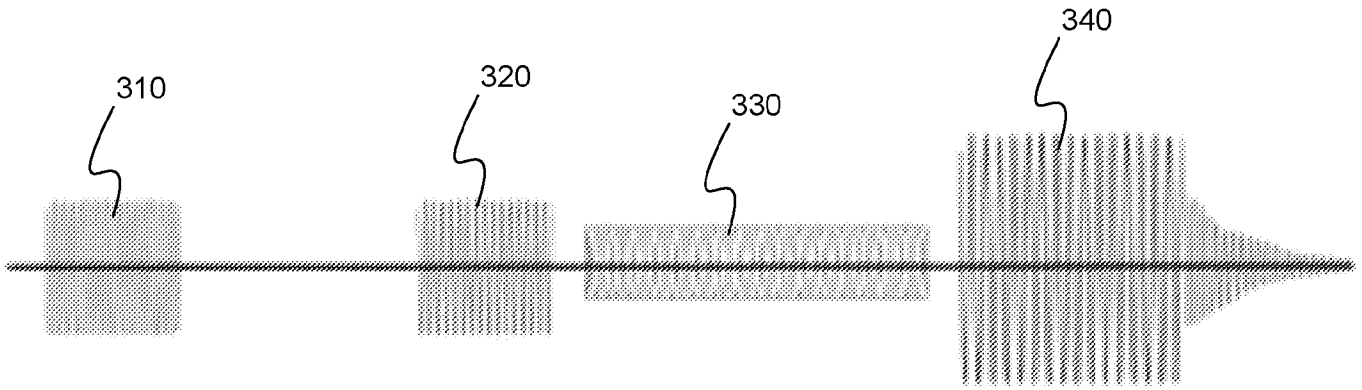
(PRIOR ART) FIG. 3
FIG. 3 is a timing diagram from the Floris Paper showing the four pulses necessary for performing two-dimensional (2D) FT-ICR mass spectrometry (MS) in the ICR cell of an FT-ICR mass spectrometer.
Figure 4:
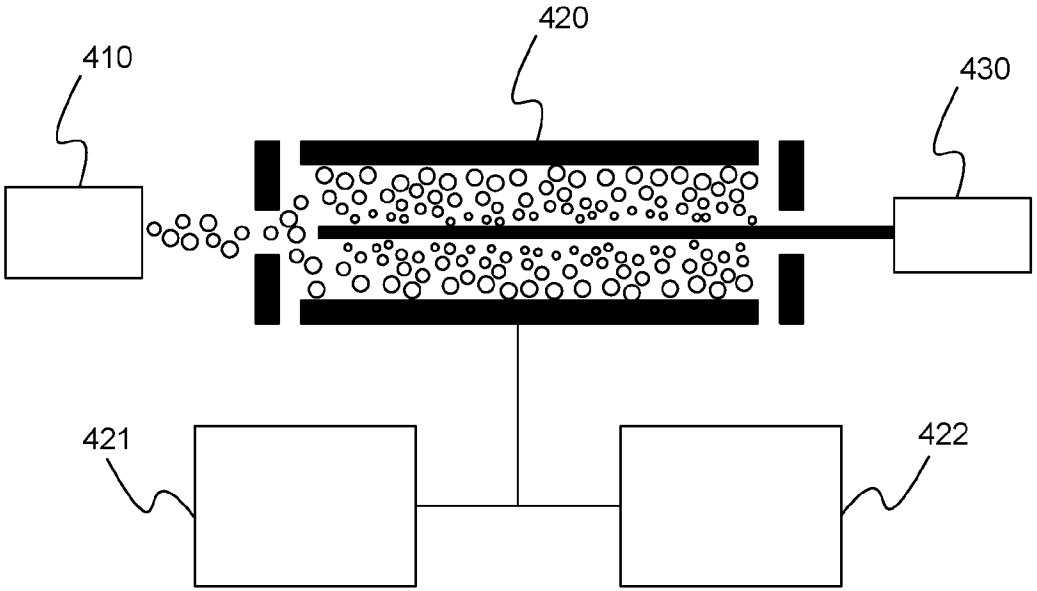
(PRIOR ART) FIG. 4
FIG. 4 is a schematic diagram of the quadrupole linear ion trap (LIT) used in the simulation in the van Agthoven Paper.
Figure 5:
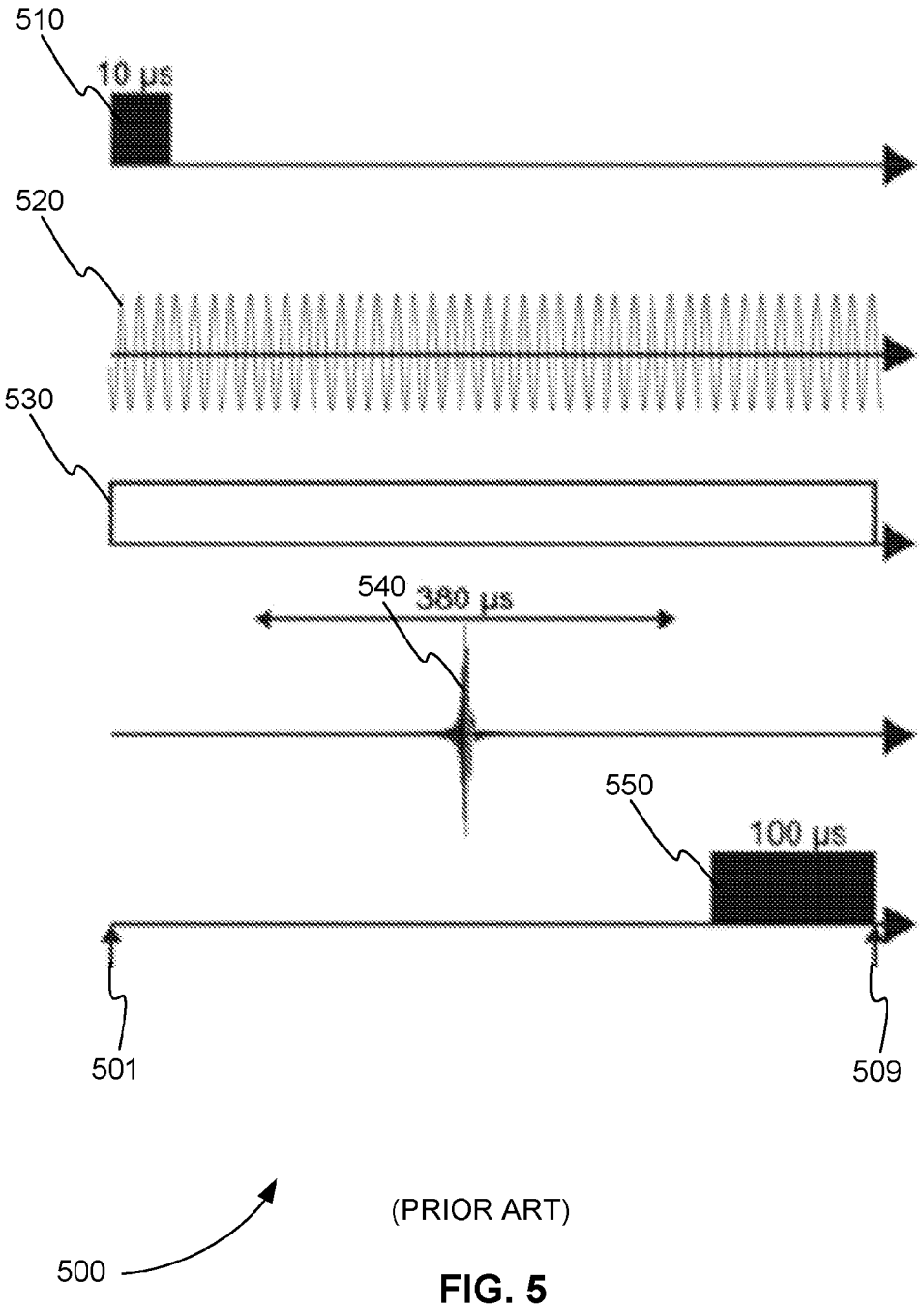
(PRIOR ART) FIG. 5
FIG. 5 is a timing diagram from the van Agthoven Paper showing the pulses applied in the quadrupole LIT simulation to allow 2D MS.

2D FT MS on an FT-ICR requires three separate pulse sequences (excitation, encoding, observe), and an ion activation step (300-400 ms) before image current detection (see FIG. 3). This requires three accurate waveforms (timing, bandwidth, voltage), and five triggers. The waveforms often need to be tuned and optimized to maximize the fragmentation efficiency. Therefore, optimization is far easier in an ELIT.

Considering the length of time it takes to generate a complete 2D mass spectrum, transients on an FT-ICR are often shortened to less than 2 seconds each, with 100's of milliseconds being common. In general, typical duty cycles for these experiments range from 50% to 85%. Based on the duty cycle, an ELIT could complete a 2D workflow faster than an FT-ICR for the same number of scans.

From a purely theoretical standpoint, the main advantage to using an FT-ICR (>7 Tesla) is to achieve very high mass resolution per unit time. However, this requires a superconducting magnet, high maintenance costs (cryogens and electricity), and a large space to house the instrument (not portable). As the ELIT is optimized, and the pressure lowered, differences in the resolution/time are narrowed. Alternatively, because of duty cycle advantage of an ELIT, longer transients could be acquired to reduce the difference in mass resolution while completing the workflow at the same time.

Due to the costs associated with owning an FT-ICR, they are often reserved for the most challenging analytical problems and have been replaced by, for example, the Orbitrap. Orbitraps, however, are unable, at this time, to perform a 2D FT MS experiments and FT-ICRs need to be modified to be capable of 2D FT MS experiments (additional cost). Therefore, access to this technique is very limited. Considering the cost of owning/operating an ELIT, more scientists can afford and utilize this technique.

To reiterate, there are, at least, three distinct differences between an FT-ICR experiment and an FT ELIT experiment. First, an FT-ICR device uses a low energy, long time (10-100's of milliseconds) irradiation directed along the axis of the ICR cell to perform radius-dependent fragmentation. An ELIT device would use a high energy, short time (10's of nanoseconds) activation directed along the radial dimension to perform axial position-dependent fragmentation. Basically, they are polar opposites.

Secondly, there is a significant delay between ion injection and detection in a 2D FT-ICR experiment, whereas they are simultaneous in an ELIT. Therefore, the duty cycle of the experiment is much higher in an ELIT, leading to shorter analysis times.

Thirdly, while this is not shown or described, the phase as a function of m/z in an FT-ICR is much more complicated than in an ELIT, requiring a lot more computing power (longer processing) to generate absorption mode mass spectra.

Figure 9:
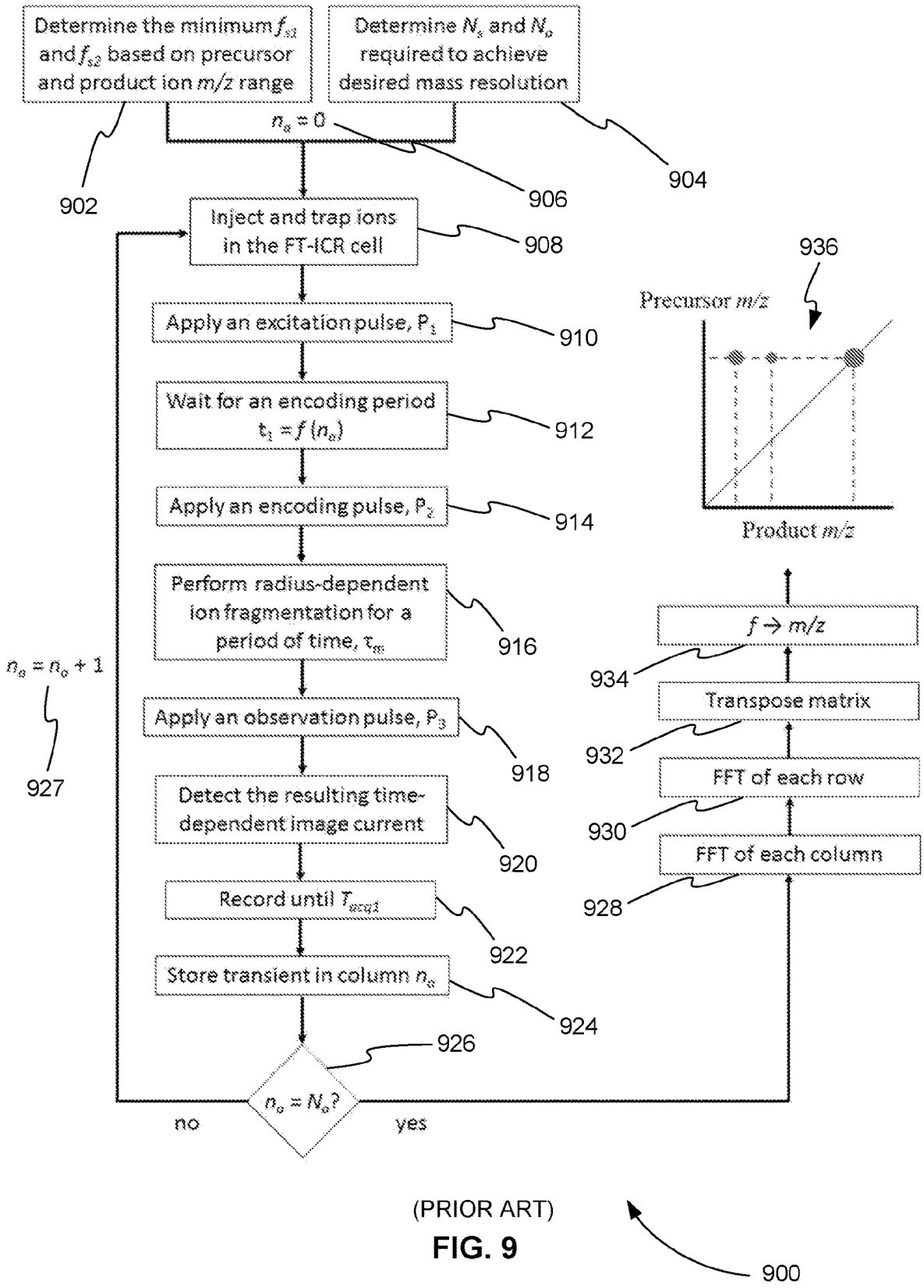
(PRIOR ART) FIG. 9
FIG. 9 is an exemplary flowchart showing a workflow for performing 2D FT MS with an FT-ICR.

FIG. 9 is an exemplary flowchart 900 showing a workflow for performing 2D FT MS with an FT-ICR. In step 902, the sampling frequency of image current, $f_{s1}$, and the effective sampling frequency, $f_{s2}$, of delay times are selected.

In step 904, the number of samples in a transient, $N_s$, and the total number of acquisitions or activation times, $N_a$, are selected. In step 906, the count of acquisitions, $n_a$, is initialized to zero.

In step 908, an acquisition is begun by injecting precursor ions into the FT-ICR and trapping them.

In step 910, an excitation pulse $P_1$ is applied.

In step 912, the time is compared to the encoding period delay, $t_l$, to determine if the encoding period has ended. The encoding period delay, $t_l$, is a function of the count of acquisitions, $n_a$. If the time is equal to the encoding period delay, then step 914 is executed.

In step 914, an encoding pulse $P_2$ is applied.

In step 916, a radius-dependent fragment is performed for a period of time, $\tau_m$.

In step 918, an observation pulse $P_2$ is applied.

In step 920, the resulting time-dependent image current is detected.

In step 922, the acquisition time is checked. The transient image current data is measured until the total acquisition time, $T_{acq1}$, is reached.

In step 924, if the total acquisition time, $T_{acq1}$, is reached, the acquisition is ended and the measured transient image current data is stored in a matrix. The measured transient image current data for the acquisition is stored in a column of the matrix representing the count of acquisitions, $n_a$, for example.

In step 926, the count of acquisitions, $n_a$, is compared to the selected total number of acquisitions, $N_a$. If the count of acquisitions, $n_a$, is less than the selected total number of acquisitions, $N_a$, the count of acquisitions, $n_a$, is incremented at step 927 and a new acquisition is begun by returning to step 908. $n_a$, is incremented in step 927 by 1, but larger increments can be used if performing non-uniform sampling. If the count of acquisitions, $n_a$, is equal to the selected total number of acquisitions, $N_a$, the experiment is ended, and the stored data is analyzed by moving to step 928.

In step 928, a Fourier transform is performed on each column of the stored matrix.

In step 930, a Fourier transform is performed on each row of the stored matrix.

In step 932, the transformed stored matrix is transposed.

In step 934, the data in the transformed stored matrix is converted from frequency data to m/z data. This data is converted using for example equation (1) described above. The converted stored matrix data can be plotted as 2D spectrum 936. 2D spectrum 936 is a 2D map with the vertical axis corresponding to the precursor ion m/z and the horizontal axis corresponding to the product ion m/z.

A comparison of FIGS. 9 and 8 shows that 2D FT MS with an FT-ICR mass spectrometer is much more complex than 2D FT MS with an ELIT mass spectrometer.

ELIT vs. Quadrupole LIT

As described above, 2D MS experiments (non-FT) have been proposed and simulated for use in a quadrupole LIT mass analyzer. The ion radii are modulated using stored waveform ion radius modulation (SWIM) and dissociated along the central axis using a simulated laser beam. The SWIM pulse is an excitation and encoding pulse and is needed in addition to a fragmentation pulse.

An ELIT can outperform a quadrupole in terms of power consumption, duty cycle, mass resolution, mass accuracy, peak capacity, and encoding simplicity. It is proposed that the quadrupole LIT mass analyzer be coupled to other mass analyzers (TOF, Orbitrap, and FT-ICR) to get around the limitations of the quadrupole. However, in doing so, other limitations and complications are imposed.

ELIT Simulation Data

SIMION v8.1 was used to simulate an ELIT of the geometry depicted in FIG. 6. The ELIT trap dimensions and operating conditions are described in Dziekonski, et al. Int. J. Mass Spectrom. 2016, 410, 12-21 and Dziekonski, et al. Anal. Chem. 2017, 89, 4392-4397, for example, which are incorporated by reference.

Three precursor (P) ions (m/z 450, 525, and 600) were started at the center of the ELIT with 2000 eV/charge kinetic energy (no radial motion was considered). This represents the case where no mass isolation was performed before precursor ion interrogation. Each ion had a charge weighting factor (CWF) of 1000. Thus, each represented an infinitely narrow packet of 1000 ions. For sake of simplicity, the following values were selected: $f_{s1}=f_{s2}=10$ MHz, $T_{acq1}=T_{acq2}=1$ millisecond, and $N_s=N_a=10{,}001$. A trajectory quality factor of 100 was used.

As the acquisition time in both dimensions was identical, the mass resolution along the autocorrelation line is identical for both precursor ions and product ions. The induced image current was measured on the centrally located pickup electrode using the electrostatic induction code provided with SIMION v8.1. As a result of the unoptimized detection electrode geometry, harmonics were expected to be present in the 2D mass spectrum.

Dissociation was performed at both turning points using a 3-millimeter wide laser spot (10 ns duration, centered at the turning point) which had a 75% chance of inducing fragmentation if a precursor ion was within the activation region. If an ion was flagged for fragmentation, the single particle was split into four ions. The first had the same m/z as the precursor, but with 25% of the charge (CWF=250). The other three represented sequential neutral losses of m/z 100, each with an equal probability of being generated. Therefore, the product ions had an m/z of P-100, P-200, and P-300, each with a CWF=250.

The workflow of FIG. 8 was followed with the described SIMION conditions. Only the activation time was changed between sequential simulations. Matlab was used to process the transients (10,001 in total) and generate a 2D mass spectrum which was calibrated for the specific ELIT geometry, potentials, and ion kinetic energy.

Figure 10:
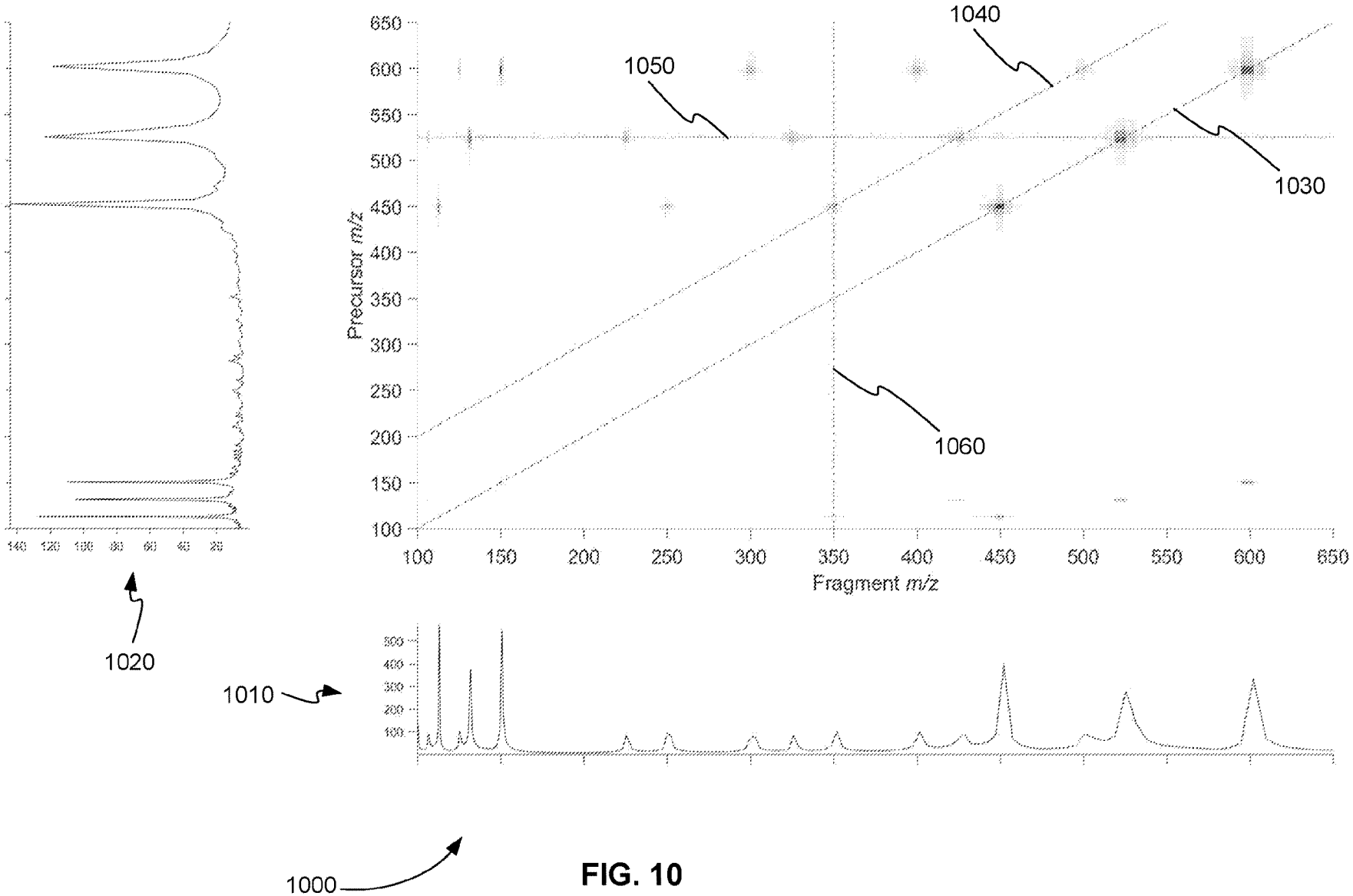
FIG. 10 is an exemplary plot of a 2D spectrum obtained from simulating 2D FT MS using an ELIT, in accordance with various embodiments.

FIG. 10 is an exemplary plot 1000 of a 2D spectrum obtained from simulating 2D FT MS using an ELIT, in accordance with various embodiments. The 2D spectrum of FIG. 10 shows that the ELIT simulation successfully performed 2D FT MS. Below the x-axis of the 2D spectrum a cumulative product ion spectrum 1010 is shown. Similarly, beside the y-axis of the 2D spectrum, a cumulative precursor ion spectrum 1020 is shown. Line 1030 is the autocorrelation line. Line 1040 is the neutral loss line. Line 1050 is a line for an extracted product ion spectrum with a precursor ion m/z of 525. Line 1060 is a line for an extracted precursor ion spectrum with a product ion m/z of 350.

Figure 11:
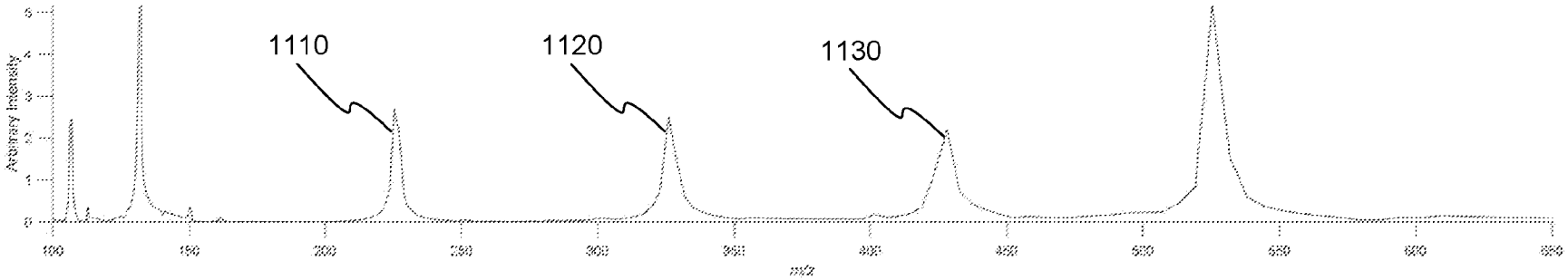
FIG. 11 is an exemplary plot of a product ion spectrum extracted from the 2D spectrum of FIG. 10 at a precursor ion m/z of 525, in accordance with various embodiments.

FIG. 11 is an exemplary plot 1100 of a product ion spectrum extracted from the 2D spectrum of FIG. 10 at a precursor ion m/z of 525, in accordance with various embodiments. The three product ions 1110, 1120, and 1130 at m/z values 225, 325, and 425, respectively, are shown in this product ion spectrum.

It is analytically useful to note that even though the three product ions contain the same number of charges, the intensity of the peak decreases with increasing m/z. This is a result of performing image current detection which is a measure of the number of Coulombs per second. An ion of higher m/z travels with a lower average velocity (v=sqrt [2zKE/m]), thereby inducing a lower instantaneous image current and a lower intensity upon Fourier transformation.

ELIT 2D FT MS System

Figure 12:
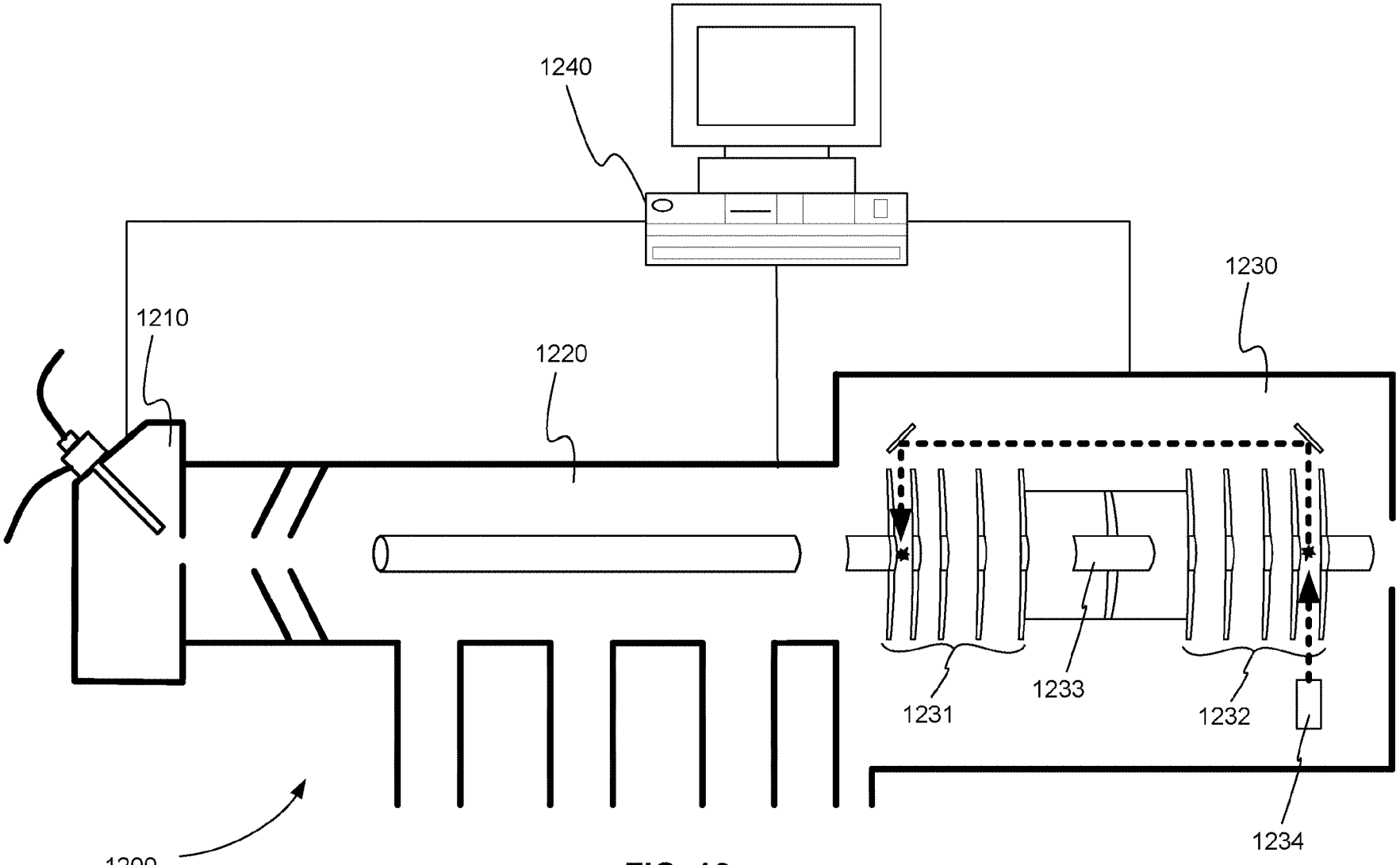
FIG. 12 is a schematic diagram of a system for controlling a mass spectrometer to simultaneously measure precursor and product ion data.

FIG. 12 is a schematic diagram 1200 of a system for controlling a mass spectrometer to simultaneously measure precursor and product ion data. The system of FIG. 12 includes ion source device 1210, ion transfer optics 1220, electrostatic linear ion trap (ELIT) 1230, and processor 1240.

Ion source device 1210 is configured to ionize a sample and produce an ion beam. Ion source device 1210 can perform ionization techniques that include, but are not limited to, matrix-assisted laser desorption/ionization (MALDI) or electrospray ionization (ESI).

ELIT 1230 includes two sets of reflectrons 1231 and 1232, one or more pickup electrodes 1233, and a fragmentation device 1234.

Processor 1240 is in communication with the ion source device 1210, ion transfer optics 1220, and ELIT 1230. This communication can include data or control information.

Processor 1240 can be, but is not limited to, the system of FIG. 1, a computer, microprocessor, microcontroller, or any device capable of sending and receiving control signals and data to and from ion source device 410, tandem mass spectrometer 401, and other devices. Processor 1240 processor further has access to one or more memory devices, like the system of FIG. 1.

Processor 1240 controls ion transfer optics 1220 and ELIT 1230 to perform a total number of acquisitions, N. Processor 1240 controls or provides instruction to ion transfer optics 1220 and ELIT 1230 by controlling one or more voltage sources (not shown) that supply ion transfer optics 1220 and ELIT 1230, for example.

For each acquisition, n, of the N acquisitions, processor 1240 performs a number of steps. Processor 1240 controls ion transfer optics 1240 to inject ions from the ion beam into ELIT 1230 causing the ions to oscillate axially between two electric fields produced by the two the sets of reflectrons 1231 and 1232.

Processor 1240 controls ELIT 1230 to measure a time domain image current of the oscillating ions from ion injection to a total acquisition time, $T_{acq1}$, using the one or more pickup electrodes 1333. Processor 1240 controls ELIT 1230 to perform position-dependent fragmentation of the oscillating ions within $T_{acq1}$ at one or both turning points of the oscillating ions adding product ions to the oscillating ions using fragmentation device 1234. The fragmentation is performed at a delay time, $t_{act}$, relative to the ion injection that is increased by a time increment, Δt, in each subsequent acquisition, n+1, making the fragmentation of the oscillating ions dependent on their position.

Finally, processor 1240 stores the measured time domain image current as a row or column n of a two-dimensional matrix in a memory device.

In various embodiments, N and Δt are chosen to provide uniform or non-uniform sampling of the precursor ion dimension.

Uniform Sampling

Figure 13:
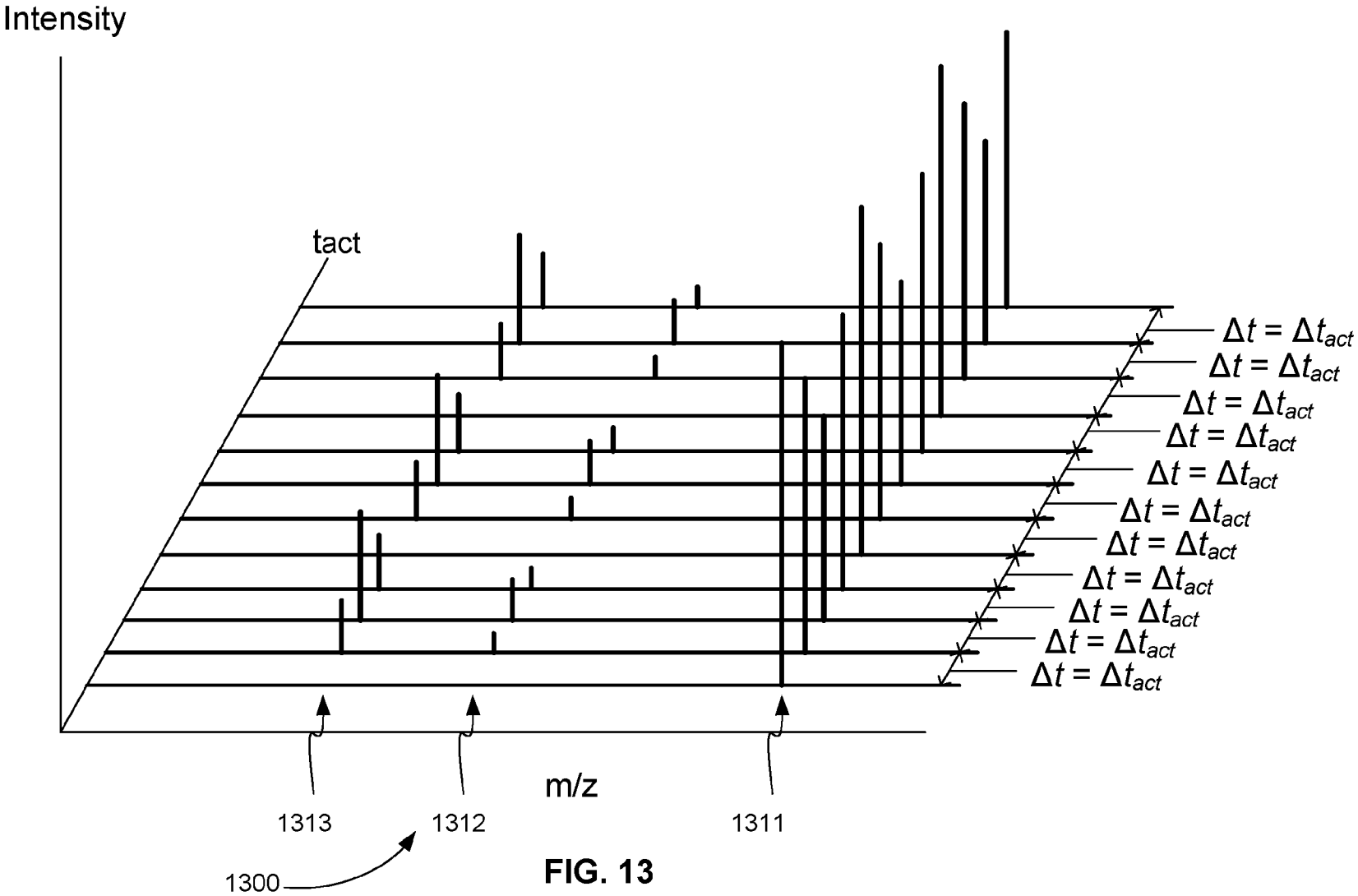
FIG. 13 is a 3D plot of hypothetical data from multiple consecutive acquisitions in which an ELIT shifts the timing of the fragmentation pulse showing uniform sampling in the precursor ion dimension, in accordance with various embodiments.

FIG. 13 is a 3D plot 1300 of hypothetical data from multiple consecutive acquisitions in which an ELIT shifts the timing of the fragmentation pulse showing uniform sampling in the precursor ion dimension, in accordance with various embodiments. Like FIG. 7, FIG. 13 shows a series of product ion spectra at different delay times, $t_{act}$, relative to the ion injection where fragmentation is performed. For each spectrum in FIG. 13, the delay time, $t_{act}$, is increased by a time increment, Δt, where $\Delta t=\Delta t_{act}$. For uniform sampling, the time increment is a constant, $\Delta t=\Delta t_{act}$=constant.

As in FIG. 7, the spectra of FIG. 13 show how the product ions 1312 and 1313 and precursor ion 1311 vary as the delay time is increased. By correlating the change in intensity with respect to the delay time, $t_{act}$, product ions and precursor ions can be matched. For example, product ions 1312 and 1313 show the same change in intensity with respect to the delay time, $t_{act}$, as precursor ion 1311 (albeit 180 degrees out of phase). As a result, product ions 1312 and 1313 are matched to precursor ion 1311.

As described above, each product ion spectrum of FIG. 13 must be sampled at a rate based on the expected lowest m/z precursor or product ion. In particular, the product ion sampling rate ($f_{s1}$) needs to be greater than twice the highest detected ion frequency (precursor ion and product ion). The m/z of product and precursor ions is converted to frequency using Equation 1, shown above. Since m/z and frequency are inversely proportional, the smallest detected precursor ion or product ion m/z produces the highest frequency. So, $f_{s1}$ is found from the smallest precursor ion or product ion m/z the experiment is expected to detect.

Similarly, the effective sampling frequency, $f_{s2}$, of the delay times, or the sampling in the precursor dimension needs to be greater than twice the highest detected ion frequency of expected precursor ions. Again, the m/z of precursor ions is converted to frequency using Equation 1, shown above. Since m/z and frequency are inversely proportional, the smallest detected precursor ion m/z produces the highest frequency. So, $f_{s2}$ is found from the smallest precursor ion m/z the experiment is expected to detect.

Resolution in the product ion dimension is increased by increasing the number of samples, $N_s$, acquired in the product ion dimension. Of course, this affects the total acquisition time, $T_{acq1}$, which is calculated according to $T_{acq1}=(N_s-1)/f_{s1}$.

Similarly, resolution in the precursor ion dimension is increased by increasing the number of acquisitions or activation times, $N_a$, in the precursor ion dimension. Of course, this affects the maximum delay time, $T_{acq2}$, which is calculated according to $T_{acq2}=(N_a-1)/f_{s2}$.

Returning to FIG. 12, in various embodiments, for uniform sampling in the precursor ion dimension, processor 1240 controls ion transfer optics 1220 and ELIT 1230 to perform a total number of acquisitions, N, where $N=N_a$. In addition, constant fragmentation is performed at a delay time, $t_{act}$, relative to the ion injection that is increased by a time increment, Δt, where $\Delta t=\Delta t_{act}$. The time difference, $\Delta t_{act}$, is a constant time difference between activation times in different acquisitions. It is chosen such that the effective sampling frequency, $f_{s2}$, of the delay times is greater than twice the detected frequency of the lightest precursor ion of interest.

In various embodiments, processor 1240 controls ELIT 1230 to measure a time domain image current of the oscillating ions using $N_s$ number of samples at a sampling rate of $f_{s1}$. The total acquisition time, $T_{acq1}$, is calculated from $T_{acq1}=(N_s-1)/f_{s1}$.

Again, in various embodiments, $f_{s1}$ is calculated from a selection of the smallest mass-to-charge ratio (m/z) of product and precursors ions to be measured, and $N_s$ is calculated from a selection of product ion mass resolution. The selection of the smallest m/z of product and precursors ions to be measured and the product ion mass resolution is made by a user of the system, for example.

In various embodiments, processor 1240 controls ELIT 1230 to increase the delay time, $t_{act}$, between ion injection and fragmentation in successive acquisitions at a sampling frequency of $f_{s2}$. The maximum delay time, $T_{acq2}$, is calculated from $T_{acq2}=(N_a-1)/f_{s2}$.

Again, in various embodiments, $f_{s2}$ is calculated from a selection of the smallest mass-to-charge ratio (m/z) of precursors ions to be measured, and $N_a$ is calculated from a selection of precursor ion mass resolution. The selection of the smallest m/z of precursors ions to be measured and the precursor ion mass resolution is made by a user of the system, for example.

Nonuniform Sampling

In a paper by Bray et al. entitled "Nonuniform Sampling Acquisition of Two-Dimensional Fourier Transform Ion Cyclotron Resonance Mass Spectrometry for Increased Mass Resolution of Tandem Mass Spectrometry Precursor Ions," Anal. Chem. 2017, 89, 8589-8593 (hereinafter the "Bray Paper") nonuniform sampling in 2D FTICR mass spectrometry is proposed. The Bray Paper is incorporated by reference herein. The Bray Paper describes that prior to nonuniform sampling, overnight acquisition was required to order to obtain quadrupole mass filter-like mass resolution from 2D FTICR mass spectrometry. In other words, nonuniform sampling was proposed to reduce the acquisition time of 2D FTICR mass spectrometry and still provide adequate resolution.

In the Bray Paper, the nonuniform sampling involves randomly skipping points in the dimension corresponding to the precursor ion selection. In other words, the precursor ion dimension is under-sampled. Fewer product ion spectra are obtained and they are obtained at random times with respect to each other. The missing points are reconstructed using an algorithm.

In various embodiments, nonuniform sampling is performed in the precursor ion dimension in ELIT 2D FT mass spectrometry. Fragmentation is still performed at a delay time, $t_{act}$, relative to the ion injection that is increased by a time increment, Δt. However, the time increment is not a constant, Δt≠constant. Instead the time increment, Δt, can vary between acquisitions.

Figure 14:
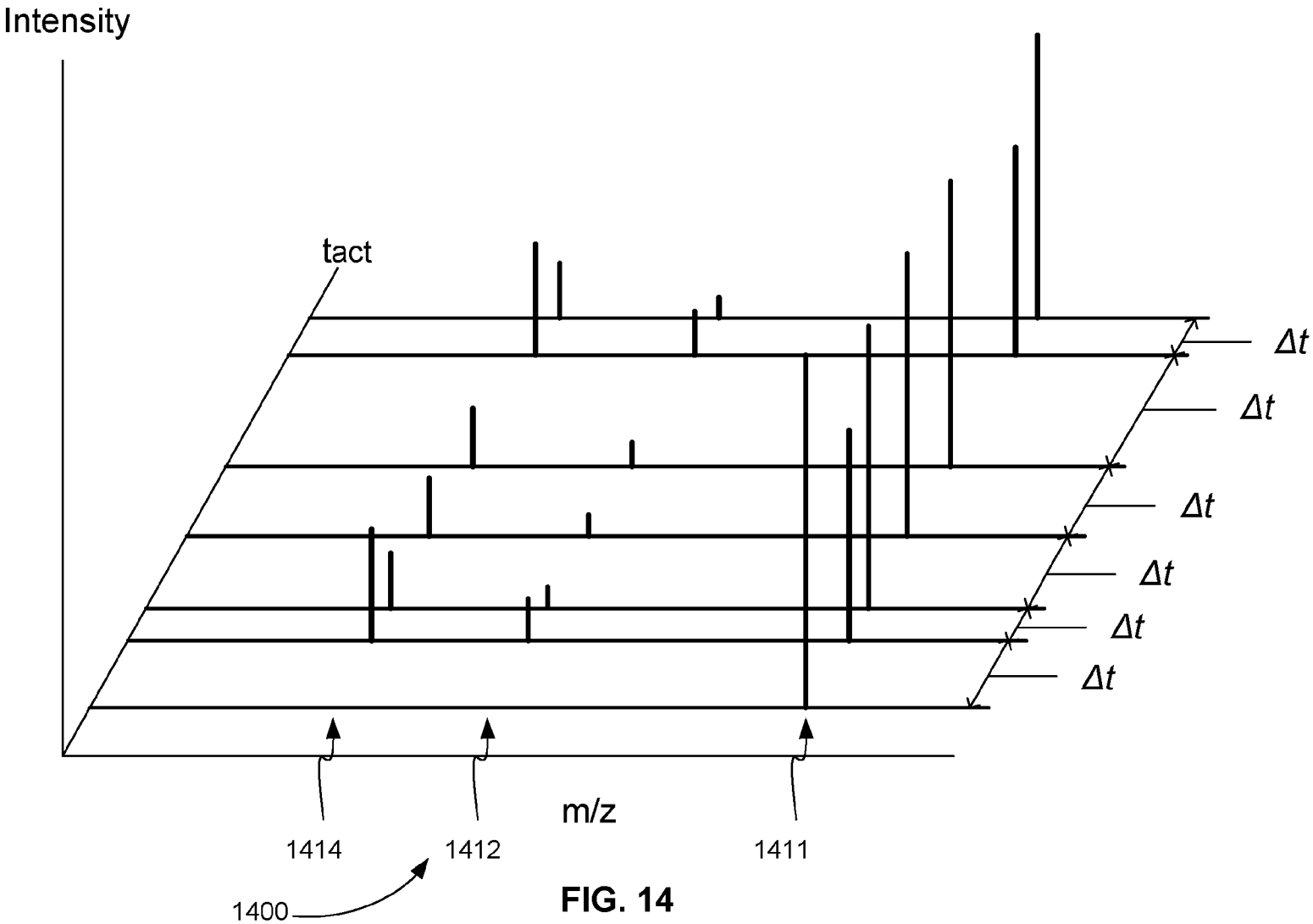
FIG. 14 is a 3D plot of hypothetical data from multiple consecutive acquisitions in which an ELIT shifts the timing of the fragmentation pulse showing nonuniform sampling in the precursor ion dimension, in accordance with various embodiments.

FIG. 14 is a 3D plot 1400 of hypothetical data from multiple consecutive acquisitions in which an ELIT shifts the timing of the fragmentation pulse showing nonuniform sampling in the precursor ion dimension, in accordance with various embodiments. Like FIG. 13, FIG. 14 shows a series of product ion spectra at different delay times, $t_{act}$, relative to the ion injection where fragmentation is performed. For each spectrum in FIG. 14, the delay time, $t_{act}$, is increased by a time increment, Δt. However, the time increment is not a constant.

In various embodiments, samples in the precursor ion dimension are still collected at some multiple of the sampling period $1/f_{s2}$.

As in FIG. 13, the spectra of FIG. 14 show how the product ions 1412 and 1413 and precursor ion 1411 vary as the delay time is increased. By correlating the change in intensity with respect to the delay time, $t_{act}$, product ions and precursor ions can be matched. For example, product ions 1412 and 1413 show the same change in intensity with respect to the delay time, $t_{act}$, as precursor ion 1411 (albeit 180 degrees out of phase). As a result, product ions 1412 and 1413 are matched to precursor ion 1411. This is much harder to see with the nonuniform spacing shown in FIG. 14. However, the correlation can be recovered by applying algorithms, such as the ones proposed in the Bray Paper, to the collected spectral data.

Returning to FIG. 12, in various embodiments, for nonuniform sampling in the precursor ion dimension, processor 1240 controls ion transfer optics 1220 and ELIT 1230 to perform a total number of acquisitions, N, where $N<N_a$. In addition, fragmentation is performed at a delay time, $t_{act}$, relative to the ion injection that is increased by a varying time increment, Δt.

OTHER EMBODIMENTS

In various embodiments, processor 1240 controls ion transfer optics 1220 to inject ions from the ion beam into ELIT 1230 using mirror-switching, in-trap potential lift, or pulse deflectors.

In various embodiments, fragmentation device 1234 includes a light source that directs a beam of light to the one or both turning points producing fragmentation by ultraviolet photo dissociation (UVPD) or infrared multiphoton dissociation.

In various embodiments, fragmentation device 1234 includes an electron source that directs a beam of electrons to the one or both turning points producing fragmentation by electron activated dissociation.

In various embodiments, fragmentation device 1234 a neutral particle source that directs a beam of neutral particles to the one or both turning points producing fragmentation by neutral particle dissociation.

In various embodiments, fragmentation device 1234 includes a surface at the one or both turning points producing surface induced dissociation (SID).

In various embodiments, processor 1240 further applies a Fourier transform to each column of the two-dimensional matrix and applies a Fourier transform to each row of the two-dimensional matrix producing a two-dimensional matrix of frequency values. Processor 1240 transposes the two-dimensional matrix of frequency values, converts the transposed two-dimensional matrix of frequency values to a matrix of mass-to-charge ratio (m/z) values based on a geometry of ELIT 1230, and plots the values of the matrix of m/z values as a two-dimensional mass spectrum.

ELIT 2D FTMS Method

Figure 15:
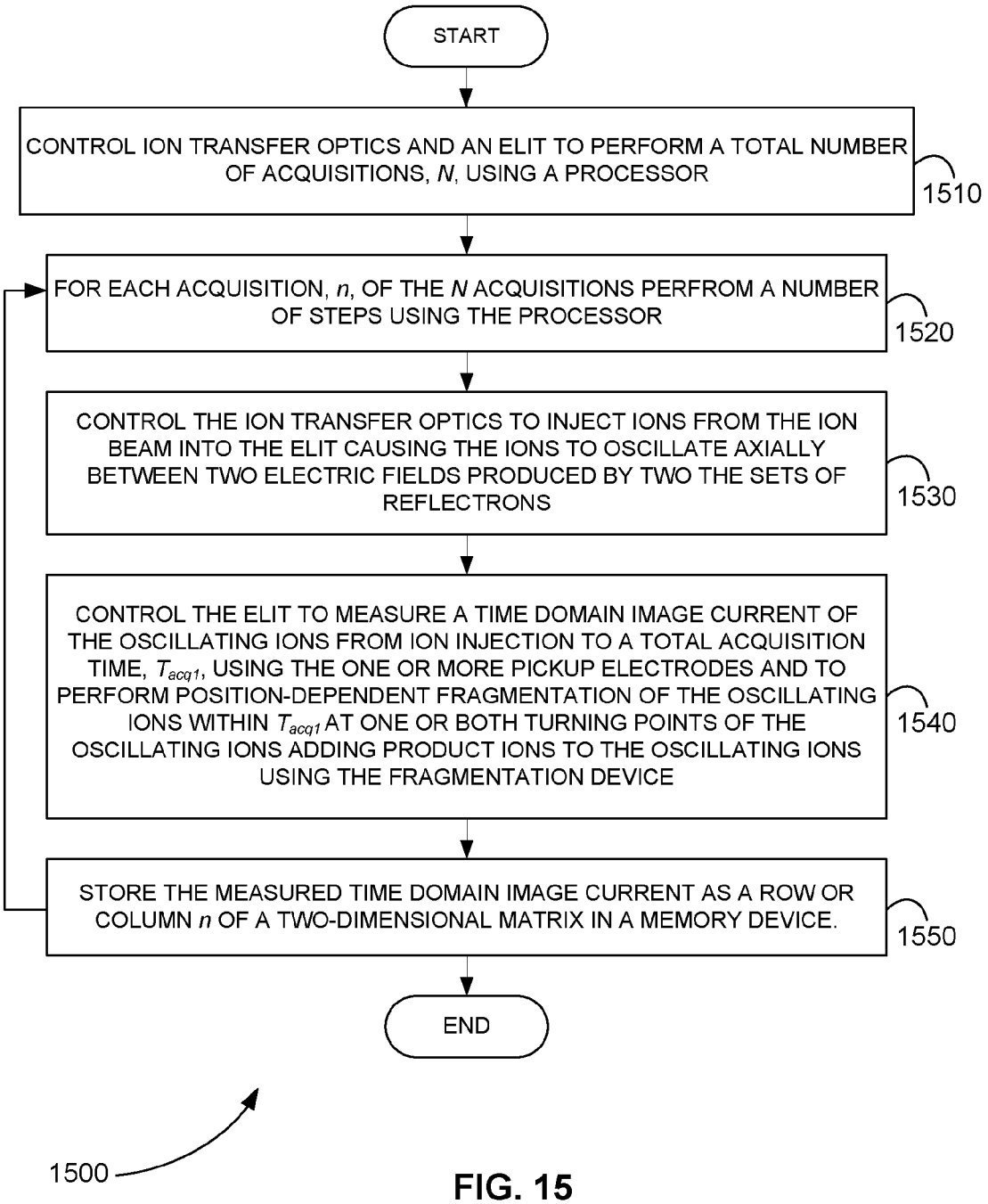
FIG. 15 is a flowchart showing a method for controlling a mass spectrometer to simultaneously measure precursor and product ion data, in accordance with various embodiments.

FIG. 15 is a flowchart 1500 showing a method for controlling a mass spectrometer to simultaneously measure precursor and product ion data, in accordance with various embodiments.

In step 1510, ion transfer optics and an ELIT are controlled to perform a total number of acquisitions, N, using a processor.

In step 1520, for each acquisition, n, of the N acquisitions a number of steps are performed using the processor.

In step 1530, the ion transfer optics are controlled to inject ions from the ion beam into the ELIT causing the ions to oscillate axially between two electric fields produced by two the sets of reflectrons. The ion beam is produced by an ion source configured to ionize a sample. The ELIT includes the two sets of reflectrons, one or more pickup electrodes, and a fragmentation device.

In step 1530, the ELIT is controlled to measure a time domain image current of the oscillating ions from ion injection to a total acquisition time, $T_{acq1}$, using the one or more pickup electrodes. And, the ELIT is controlled to perform position-dependent fragmentation of the oscillating ions within $T_{acq1}$ at one or both turning points of the oscillating ions adding product ions to the oscillating ions using the fragmentation device. The fragmentation is performed at a delay time, $t_{act}$, relative to the ion injection that is increased by a time increment, Δt, in each subsequent acquisition, n+1, making the fragmentation of the oscillating ions dependent on their position.

In step 1550, the measured time domain image current is stored as a row or column n of a two-dimensional matrix in a memory device.

ELIT 2D FT MS Computer Program Product

In various embodiments, computer program products include a tangible computer-readable storage medium whose contents include a program with instructions being executed on a processor to perform a method for controlling a mass spectrometer to simultaneously measure precursor and product ion data. This method is performed by a system that includes one or more distinct software modules.

Figure 16:
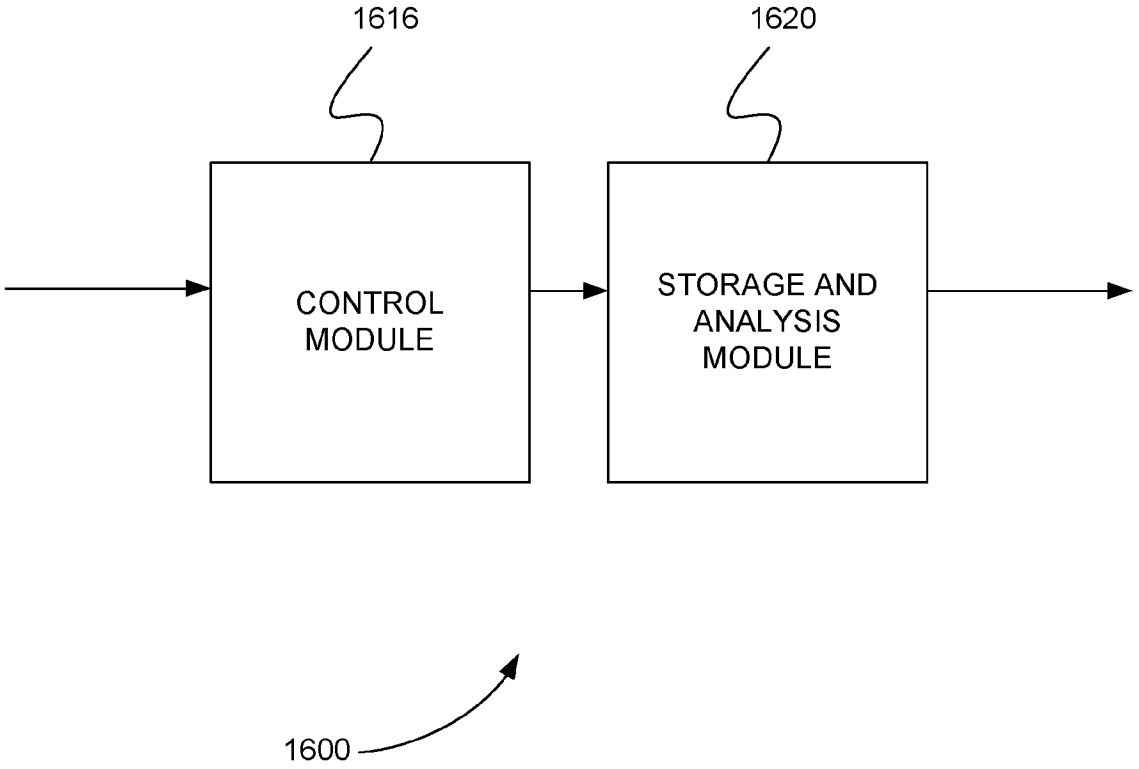
FIG. 16 is a schematic diagram of a system that includes one or more distinct software modules that perform a method for controlling a mass spectrometer to simultaneously measure precursor and product ion data, in accordance with various embodiments.

FIG. 16 is a schematic diagram of a system 1600 that includes one or more distinct software modules that perform a method for controlling a mass spectrometer to simultaneously measure precursor and product ion data, in accordance with various embodiments. System 1600 includes control module 1610 and storage and analysis module 1620.

Control module 1610 controls ion transfer optics and an ELIT to perform a total number of acquisitions, N. For each acquisition, n, of the N acquisitions, a number of steps are performed.

Control module 1610 controls the ion transfer optics to inject ions from the ion beam into the ELIT causing the ions to oscillate axially between two electric fields produced by two the sets of reflectrons. The ion beam is produced by an ion source configured to ionize a sample. The ELIT includes the two sets of reflectrons, one or more pickup electrodes, and a fragmentation device.

Control module 1610 controls the ELIT to measure a time domain image current of the oscillating ions from ion injection to a total acquisition time, $T_{acq1}$, using the one or more pickup electrodes. Control module 1610 controls the ELIT to perform position-dependent fragmentation of the oscillating ions within $T_{acq1}$ at one or both turning points of the oscillating ions adding product ions to the oscillating ions using the fragmentation device. The fragmentation is performed at a delay time, $t_{act}$, relative to the ion injection that is increased by a time increment, Δt, in each subsequent acquisition, n+1, making the fragmentation of the oscillating ions dependent on their position.

Storage and analysis module 1620 stores the measured time domain image current as a row or column n of a two-dimensional matrix in a memory device.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for controlling a mass spectrometer to simultaneously measure precursor and product ion data, comprising:

an ion source device configured to ionize a sample and produce an ion beam;

ion transfer optics;

an electrostatic linear ion trap (ELIT) that includes two sets of reflectrons, one or more pickup electrodes, and a fragmentation device; and a processor in communication with the ion source device, the ion transfer optics, and the ELIT that controls the ion transfer optics and ELIT to perform a total number of acquisitions, N, and, for each acquisition, n, of the N acquisitions, controls the ion transfer optics to inject ions from the ion beam into the ELIT causing the ions to oscillate axially between two electric fields produced by the two the sets of reflectrons, controls the ELIT to measure a time domain image current of the oscillating ions from ion injection to a total acquisition time, $T_{acq1}$, using the one or more pickup electrodes and to perform position-dependent fragmentation of the oscillating ions within $T_{acq1}$ at one or both turning points of the oscillating ions adding product ions to the oscillating ions using the fragmentation device, wherein the fragmentation is performed at a delay time, $t_{act}$, relative to the ion injection that is increased by a time increment, Δt, in each subsequent acquisition, n+1, making the fragmentation of the oscillating ions dependent on their position, and stores the measured time domain image current as a row or column $n_a$ of a two-dimensional matrix in a memory device.

2. The system of claim 1, wherein the processor controls the ELIT to perform uniform sampling in the precursor dimension by setting the total number of acquisitions, N, to $N=N_a$, wherein $N_a$ is calculated from a selection of precursor ion mass resolution, increasing the delay time, $t_{act}$, between ion injection and fragmentation in successive acquisitions at a sampling frequency of $f_{s2}$, wherein the maximum delay time, $T_{acq2}$, is calculated from $T_{acq2}=(N_a-1)/f_{s2}$, wherein $f_{s2}$ is calculated from a selection of the smallest mass-to-charge ratio (m/z) of precursors ions to be measured, and wherein the time increment, Δt, is a constant time increment, $\Delta t_{act}$.

3. The system of claim 2, wherein $f_{s1}$ is calculated from a selection of the smallest mass-to-charge ratio (m/z) of product and precursors ions to be measured and $N_s$ is calculated from a selection of product ion mass resolution.

4. The system of claim 1, wherein the processor controls the ELIT to perform nonuniform sampling in the precursor dimension by varying the time increment, Δt, in successive acquisitions.

5. The system of claim 1, wherein the processor controls the ELIT to measure a time domain image current of the oscillating ions using $N_s$ number of samples at a sampling rate of $f_{s1}$, wherein the total acquisition time, $T_{acq1}$, is calculated from $T_{acq1}=(N_s-1)/f_{s1}$.

6. The system of claim 1, wherein the processor controls the ion transfer optics to inject ions from the ion beam into the ELIT using mirror-switching.

7. The system of claim 1, wherein the processor controls the ion transfer optics to inject ions from the ion beam into the ELIT using in-trap potential lift.

8. The system of claim 1, wherein the processor controls the ion transfer optics to inject ions from the ion beam into the ELIT using pulse deflectors.

9. The system of claim 1, wherein the fragmentation device includes a light source that directs a beam of light to the one or both turning points producing fragmentation by ultraviolet photo dissociation (UVPD) or infrared multiphoton dissociation.

10. The system of claim 1, wherein the fragmentation device includes an electron source that directs a beam of electrons to the one or both turning points producing fragmentation by electron activated dissociation.

11. The system of claim 1, wherein the fragmentation device includes a neutral particle source that directs a beam of neutral particles to the one or both turning points producing fragmentation by neutral particle dissociation.

12. The system of claim 1, wherein the fragmentation device includes a surface at the one or both turning points producing surface induced dissociation (SID).

13. The system of claim 1, wherein the processor further applies a Fourier transform to each column of the two-dimensional matrix and applies a Fourier transform to each row of the two-dimensional matrix producing a two-dimensional matrix of frequency values, transposes the two-dimensional matrix of frequency values, converts the transposed two-dimensional matrix of frequency values to a matrix of mass-to-charge ratio (m/z) values based on a geometry of the ELIT, and plots the values of the matrix of m/z values as a two-dimensional mass spectrum.

14. A method for controlling a mass spectrometer to simultaneously measure precursor and product ion data, comprising:

controlling ion transfer optics and an ELIT to perform a total number of acquisitions, N, using a processor and, for each acquisition, n, of the N acquisitions, controlling the ion transfer optics to inject ions from the ion beam into the ELIT causing the ions to oscillate axially between two electric fields produced by two the sets of reflectrons using the processor, wherein the ion beam is produced by an ion source configured to ionize a sample and wherein the ELIT includes the two sets of reflectrons, one or more pickup electrodes, and a fragmentation device, controlling the ELIT to measure a time domain image current of the oscillating ions from ion injection to a total acquisition time, $T_{acq1}$, using the one or more pickup electrodes and to perform position-dependent fragmentation of the oscillating ions within $T_{acq1}$ at one or both turning points of the oscillating ions adding product ions to the oscillating ions using the fragmentation device using the processor, wherein the fragmentation is performed at a delay time, $t_{act}$, relative to the ion injection that is increased by a time increment, $\Delta t_{act}$, in each subsequent acquisition, n+1, making the fragmentation of the oscillating ions dependent on their position, and storing the measured time domain image current as a row or column n of a two-dimensional matrix in a memory device.

15. A computer program product, comprising a non-transitory and tangible computer-readable storage medium whose contents include a program with instructions being executed on a processor so as to perform a method for controlling a mass spectrometer to simultaneously measure precursor and product ion data, the method comprising:

providing a system, wherein the system comprises one or more distinct software modules, and wherein the distinct software modules comprise a control module and a storage and analysis module; and controlling ion transfer optics and an ELIT to perform a total number of acquisitions, N, using the control module and, for each acquisition, n, of the N acquisitions, controlling the ion transfer optics to inject ions from the ion beam into the ELIT causing the ions to oscillate axially between two electric fields produced by two the sets of reflectrons using the control module, wherein the ion beam is produced by an ion source configured to ionize a sample and wherein the ELIT includes the two sets of reflectrons, one or more pickup electrodes, and a fragmentation device, controlling the ELIT to measure a time domain image current of the oscillating ions from ion injection to a total acquisition time, $T_{acq1}$, using the one or more pickup electrodes and to perform position-dependent fragmentation of the oscillating ions within $T_{acq1}$ at one or both turning points of the oscillating ions adding product ions to the oscillating ions using the fragmentation device using the control module, wherein the fragmentation is performed at a delay time, $t_{act}$, relative to the ion injection that is increased by a time increment, $\Delta t$, in each subsequent acquisition, n+1, making the fragmentation of the oscillating ions dependent on their position, and storing the measured time domain image current as a row or column n of a two-dimensional matrix in a memory device using the storage and analysis module.

* * * * *